US008007091B2

(12) United States Patent
Nakamura et al.

(10) Patent No.: US 8,007,091 B2
(45) Date of Patent: Aug. 30, 2011

(54) INK SUPPLY DEVICE

(75) Inventors: Hirotake Nakamura, Nagoya (JP); Hiroaki Yazawa, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 465 days.

(21) Appl. No.: 12/325,483

(22) Filed: Dec. 1, 2008

(65) Prior Publication Data

US 2009/0141100 A1 Jun. 4, 2009

(30) Foreign Application Priority Data

Nov. 30, 2007 (JP) ..... 2007-311788

(51) Int. Cl.
*B41J 2/175* (2006.01)

(52) U.S. Cl. ..... 347/86; 347/85; 347/87

(58) Field of Classification Search ..... 347/85–87
See application file for complete search history.

(56) References Cited

U.S. PATENT DOCUMENTS 6,312,105 B1 * 11/2001 Miyauchi ..... 347/49
7,792,460 B2 * 9/2010 Yamaguchi et al. ..... 399/111
2005/0168545 A1 8/2005 Sakai et al.
2005/0260010 A1 * 11/2005 Yokota ..... 399/111
2006/0164448 A1 * 7/2006 Sugiyama et al. ..... 347/5
2007/0237544 A1 * 10/2007 Kawai ..... 399/111
2008/0136879 A1 6/2008 Sakai et al.
2009/0103945 A1 * 4/2009 Kayahara et al. ..... 399/119

FOREIGN PATENT DOCUMENTS

JP 2005-254794 9/2005
JP 2006116784 5/2006

* cited by examiner

*Primary Examiner* — Ellen Kim
(74) *Attorney, Agent, or Firm* — Frommer Lawrence & Haug LLP

(57) ABSTRACT

An ink supply device includes: an ink cartridge including a port which is provided in a rear surface thereof at a lower portion of the ink chamber and which allows ink to flow in an ink flow direction and an engaged portion which is provided on an upper surface thereof; a cartridge mounting portion into which the ink cartridge is insertable in an insertion direction wherein the cartridge mounting portion is configured to accommodate the ink cartridge movably between a first posture and a second posture; a joint which is provided in the cartridge mounting portion and is connected to the port; a first elastic member which urges the ink cartridge to a removal direction; and a lock member which is engaged with the engaged portion to prevent the ink cartridge from being moved in the removal direction by the urging force of the first elastic member.

12 Claims, 15 Drawing Sheets

INK SUPPLY DEVICE

CROSS-REFERENCE TO RELATED APPLICATION

This application claims priority from Japanese Patent Application No. 2007-311788, filed on Nov. 30, 2007, the entire subject matter of which is incorporated herein by reference.

TECHNICAL FIELD

Aspects of the present invention relate to an ink supply device in which an ink cartridge having a port through which ink flows out is inserted into a cartridge mounting portion having a joint and the port is connected to the joint.

BACKGROUND

An image recording apparatus uses ink to record images on a sheet (recording medium). Such image recording apparatus includes an ink-jet recording head, and selectively discharges ink droplets onto a recording sheet from the nozzles of the recording head. The ink droplets are dropped on the recording sheet, and a desired image is recorded on the recording sheet. The image recording apparatus is configured to mountable thereon an ink cartridge that stores ink to be supplied to the recording head. The ink cartridge is generally a cartridge type, and can be inserted into or removed from a-cartridge mounting portion provided in the image recording apparatus. When no ink remains in the ink cartridge, the ink cartridge is removed from the cartridge mounting portion of the image recording apparatus, and a new ink cartridge having ink stored therein is inserted into the cartridge mounting portion. The image recording apparatus in which the ink cartridge can be inserted into or removed from the cartridge mounting portion has a configuration that positions the ink cartridge or locks the inserted ink cartridge.

JP-A-2005-254794 describes a configuration in which an unlocking mechanism 33 is provided in a cartridge holding means 30. The unlocking mechanism 33includes: an unlocking pin 34that is rotated together with an ink cartridge 11when a lever arm 31 is rotated; and an elastic unlocking piece 35 that changes the movement direction of the unlocking pin 34to be different from the direction in which the ink cartridge 11is inserted or removed, thereby unlocking the ink cartridge 11. In this way, when the ink cartridge 11 is inserted, it is possible to simply and reliably insert the ink cartridge 11 with a very small pressing force.

JP-A-2006-116784 describes a configuration in which the position of an ink tank 10 in the horizontal direction is determined by positioning protrusions 25 that are formed on a left side wall 14of the ink tank and a left side wall 23 of an ink tank holder 20 and the position of the ink tank 10 in the vertical direction is determined by a memory claw 17 of the ink tank 10 and a positioning stopper 30 of the ink tank holder 20. In this configuration, when a door 60 of the ink tank holder 20 is opened, a claw deforming means 40deforms the memory claw 17 to disengage the memory claw 17 from the positioning stopper 30 , and a spring 50 urges the ink tank 10 above the ink tank holder 20.

In order to easily insert an ink cartridge into a cartridge mounting portion, the dimensions of the cartridge mounting portion are set to be slightly larger than those of the ink cartridge member in consideration of, for example, a size errors or an insertion error. In this way, the ink cartridge may rattle a little in the cartridge mounting portion, which is generally called 'backlash'. In general, ink is stored in the ink cartridge, and the backlash causes the position of the ink cartridge inserted into the cartridge mounting portion to be unstable. In this case, ink is likely to lean toward a port through which ink is drained from the ink cartridge or ink is likely to lean toward the opposite side of the port. In an ink-jet image recoding apparatus, it is not preferable that air bubbles flow into the recording head. In order to reduce or prevent the air bubbles from flowing from the ink cartridge to the recording head through the port, the port has generally been provided in the vicinity of the lower surface of the ink chamber such that the port is lower than the level of ink all the time. In addition, in consideration of the position of the ink cartridge, the remaining amount of ink is set such that the level of ink is not lower than the position of the port. Therefore, the ink cartridge is replaced without using up the ink. However, when the position of the ink cartridge is unstable in the cartridge mounting portion, the ink cartridge needs to be designed such that a large amount of ink remains in the cartridge.

An image recording apparatus is desired to be small. In order to meet the desire, it is preferable that a lock mechanism provided in the cartridge mounting portion be as simple and small as possible. In addition, in a color image recording apparatus, a plurality of ink cartridges corresponding to a plurality of color inks are used. Therefore, it is desired to reduce the thickness of the ink cartridge.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a mechanism capable of reducing the amount of ink remaining in an ink cartridge.

Additionally, it is another aspect of the present invention to provide a mechanism capable of simply detecting whether an ink cartridge is completely inserted in a cartridge mounting portion.

Further, it is another aspect of the present invention to provide a small ink supply device.

According to an exemplary embodiment of the present invention, there is provided an ink supply device including: an ink cartridge including an ink chamber for storing ink, a port which is provided in a rear surface thereof at a lower portion of the ink chamber in a gravity direction and which allows ink to flow from the ink chamber to outside in an ink flow direction, and an engaged portion which is provided on an upper surface thereof, a cartridge mounting portion into which the ink cartridge is insertable in an insertion direction from the rear surface of the ink cartridge, wherein the cartridge mounting portion is configured to accommodate the ink cartridge movably between a first posture in which the ink flow direction of the port is aligned with the insertion direction and a second posture in which the ink cartridge is inclined so that a downstream of the port in the ink flow direction is lower than an upstream of the port; a joint which is provided in the cartridge mounting portion and is connected to the port of the ink cartridge inserted into the cartridge mounting portion; a first elastic member which urges the ink cartridge inserted into the cartridge mounting portion to a removal direction opposite to the insertion direction; and a lock member which is engaged with the engaged portion of the ink cartridge inserted into the cartridge mounting portion to prevent the ink cartridge from being moved in the removal direction by the urging force of the first elastic member.

According to another exemplary embodiment of the present invention, there is provided an ink cartridge accommodating device for accommodating an ink cartridge including a first part, a second part movable relative to the first part in a movement direction, and a spring which is provided between the first part and the second part and urges to be separated in the movement direction, wherein the first part includes a port which extends in a first extending direction and allows an ink therein to flow outside. The ink cartridge accommodating device includes: a cartridge accommodating portion into which the ink cartridge is insertable from the second part in an insertion direction aligned with the first extending direction, the cartridge accommodating portion including a joint extending in a second extending direction to which the port of the ink cartridge is connected, the cartridge accommodating portion configured to accommodate the ink cartridge movably between a first posture in which the first extending direction of the port is aligned with the second extending direction of the joint and a second posture in which the first extending direction of the port is inclined from the second extending direction of the joint; and a lock member which is provided at an upper portion of the cartridge accommodating portion and is configured to contact a portion of the first part of the ink cartridge inserted in the cartridge accommodating portion.

BRIEF DESCRIPTION OF THE DRAWINGS

The above and other aspects of the present invention will become more apparent and more readily appreciated from the following description of exemplary embodiments of the present invention taken in conjunction with the attached drawings, in which:

FIG. 2A is a perspective view illustrating a slider disposed at a first position, and FIG. 2B is a perspective view illustrating the slider disposed at a second position;

FIG. 3A is a side view illustrating the slider disposed at the first position, and FIG. 3B is a side view illustrating the slider disposed at the second position;

FIG. 4A is a perspective view illustrating the cartridge body, as viewed from a rear surface, and 4B is a perspective view illustrating the cartridge body, as viewed from a front surface;

FIG. 8A shows the detailed sectional configuration of a portion VIIIA (the vicinity of an upper part of the slider) surrounded by a two-dot chain line in FIGS. 7, and 8B shows the detailed sectional configuration of a portion VIIIB (the vicinity of a lower part of the slider) surrounded by a two-dot chain line in FIG. 7;

DETAILED DESCRIPTION

Hereinafter, illustrative non-limiting exemplary embodiments of the present invention will be described with reference to the accompanying drawings. It will be understood by those skilled in the art that various changes in form and details may be made therein without departing from the spirit and scope of the invention as defined by the appended claims.

[Description of the Drawings]

Figure 1:
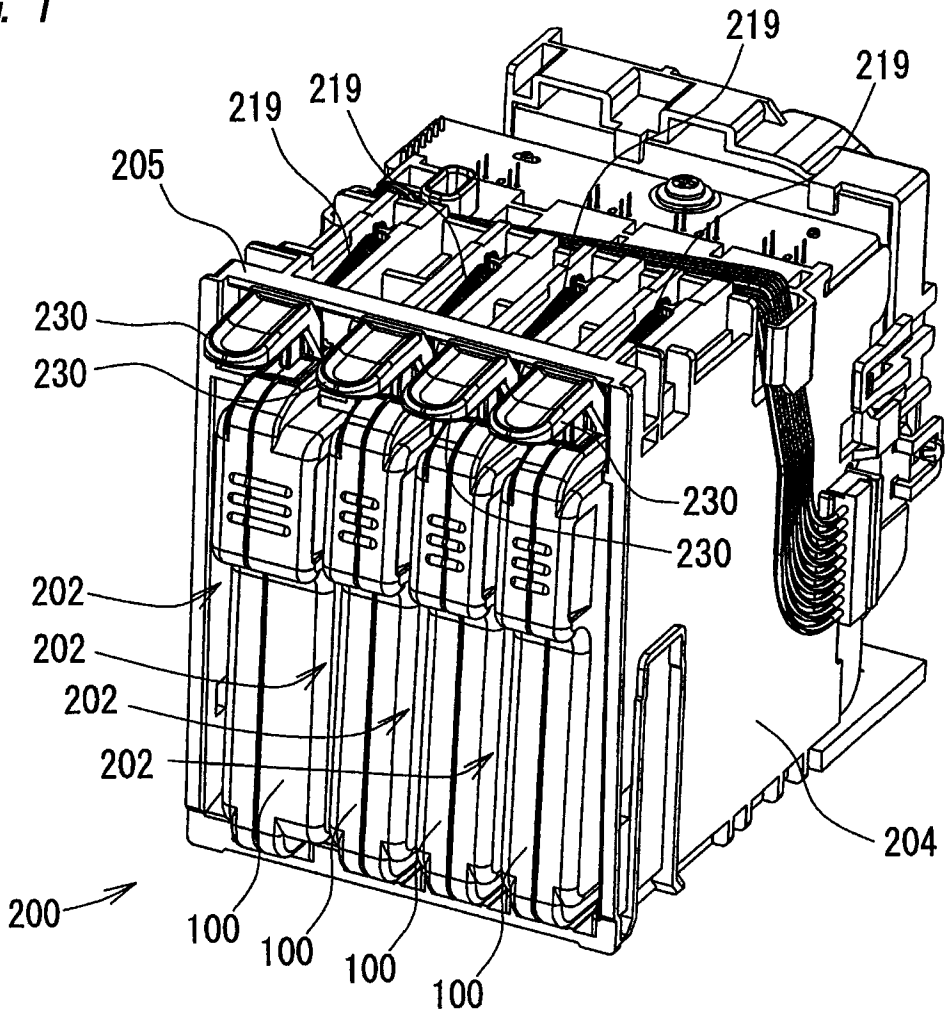
FIG. 1 is a perspective view illustrating the external configuration of an ink supply device having an ink cartridge inserted thereinto according to an exemplary embodiment of the present invention.
Figure 2B:
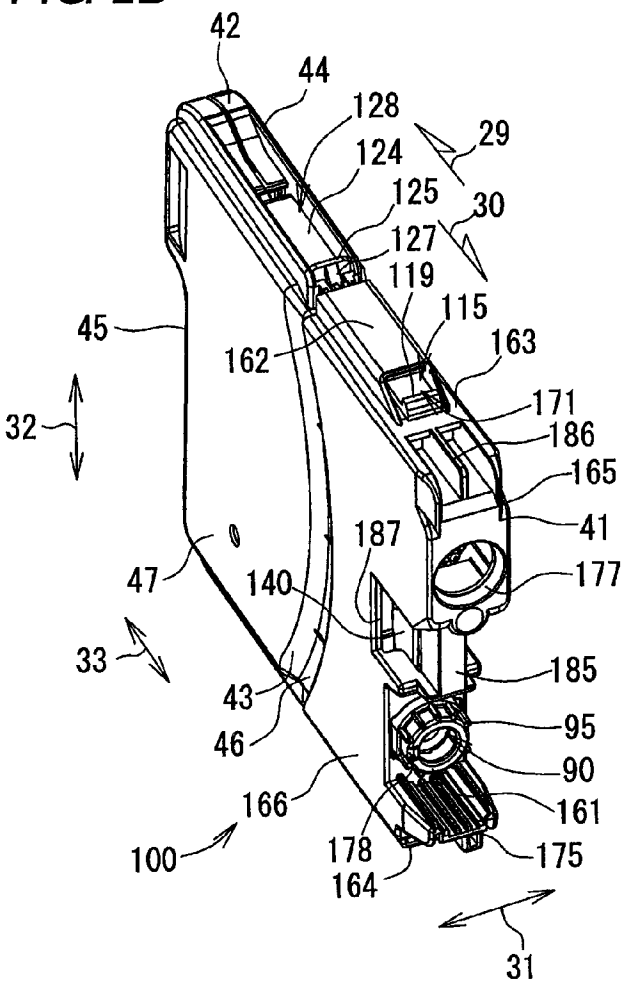
FIGS. 2A and 2B are perspective views illustrating the external configuration of the ink cartridge according to an exemplary embodiment of the present invention, specifically.
Figure 2A:
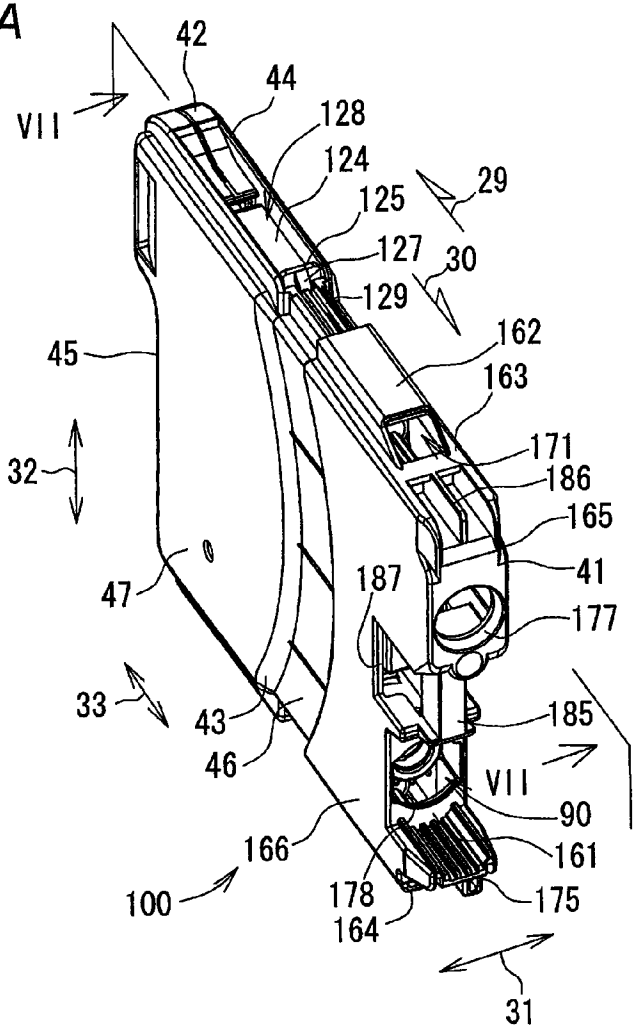
Figure 3A:
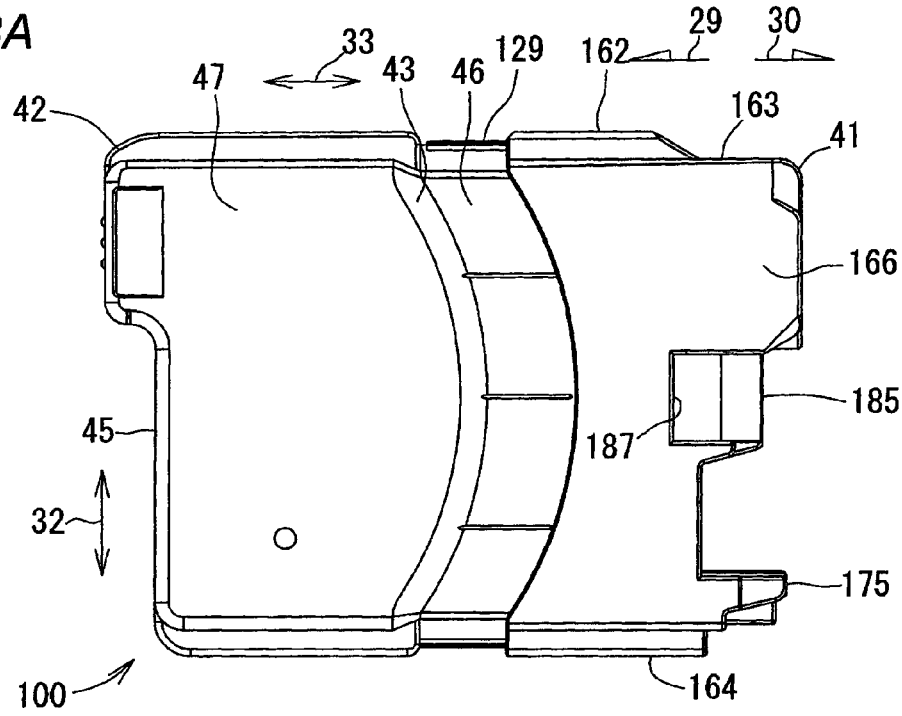
FIGS. 3A and 3B are side views illustrating the ink cartridge, specifically.
Figure 3B:
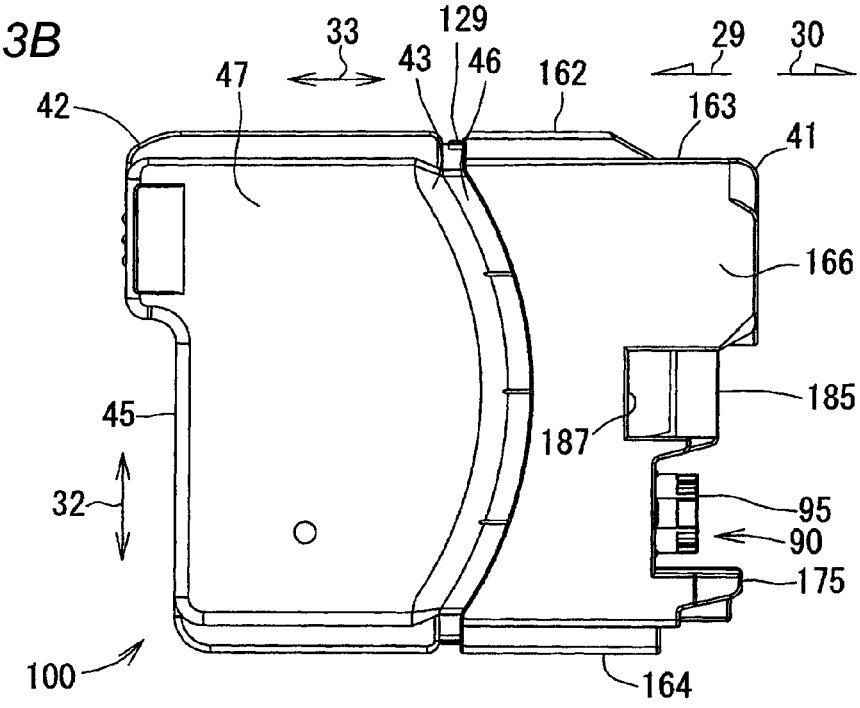
Figure 4B:
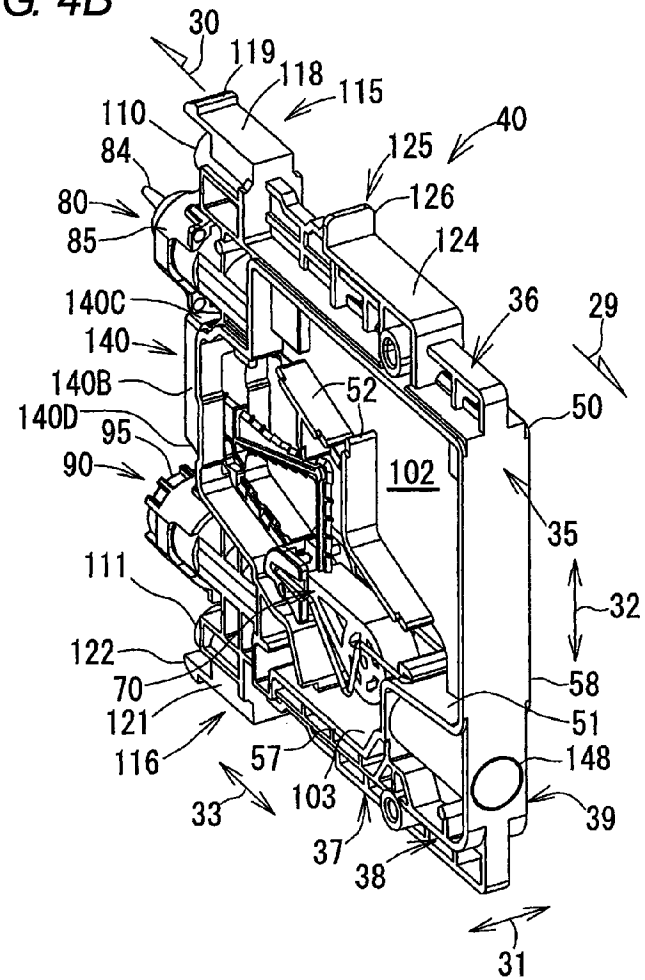
FIGS. 4A and 4B are perspectives view illustrating the configuration of a cartridge body of the ink cartridge, specifically.
Figure 4A:
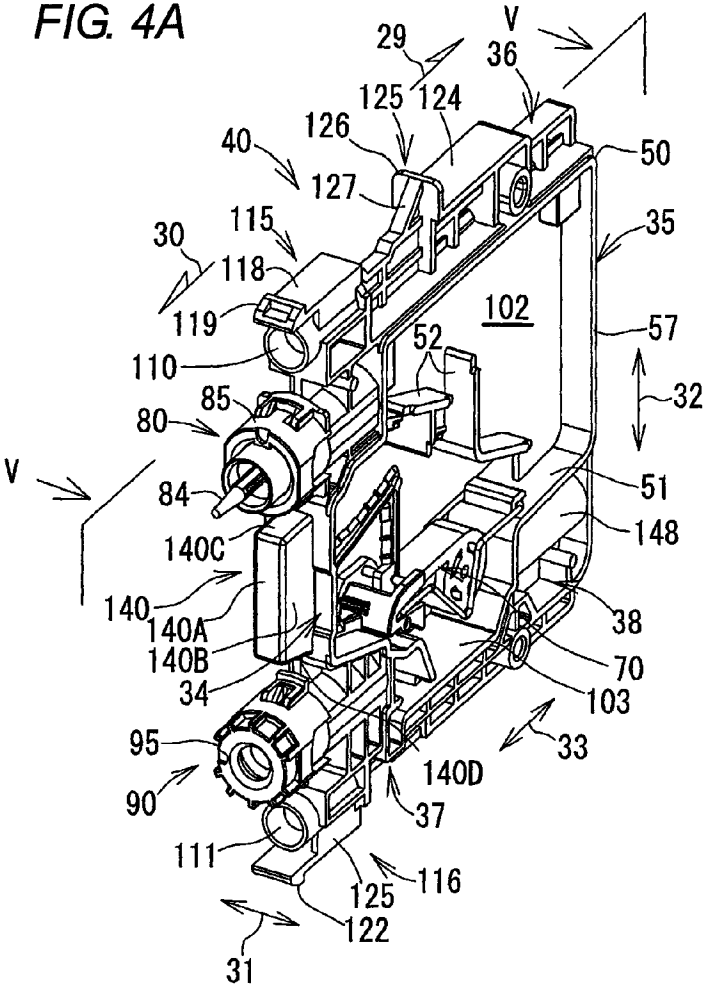
Figure 5:
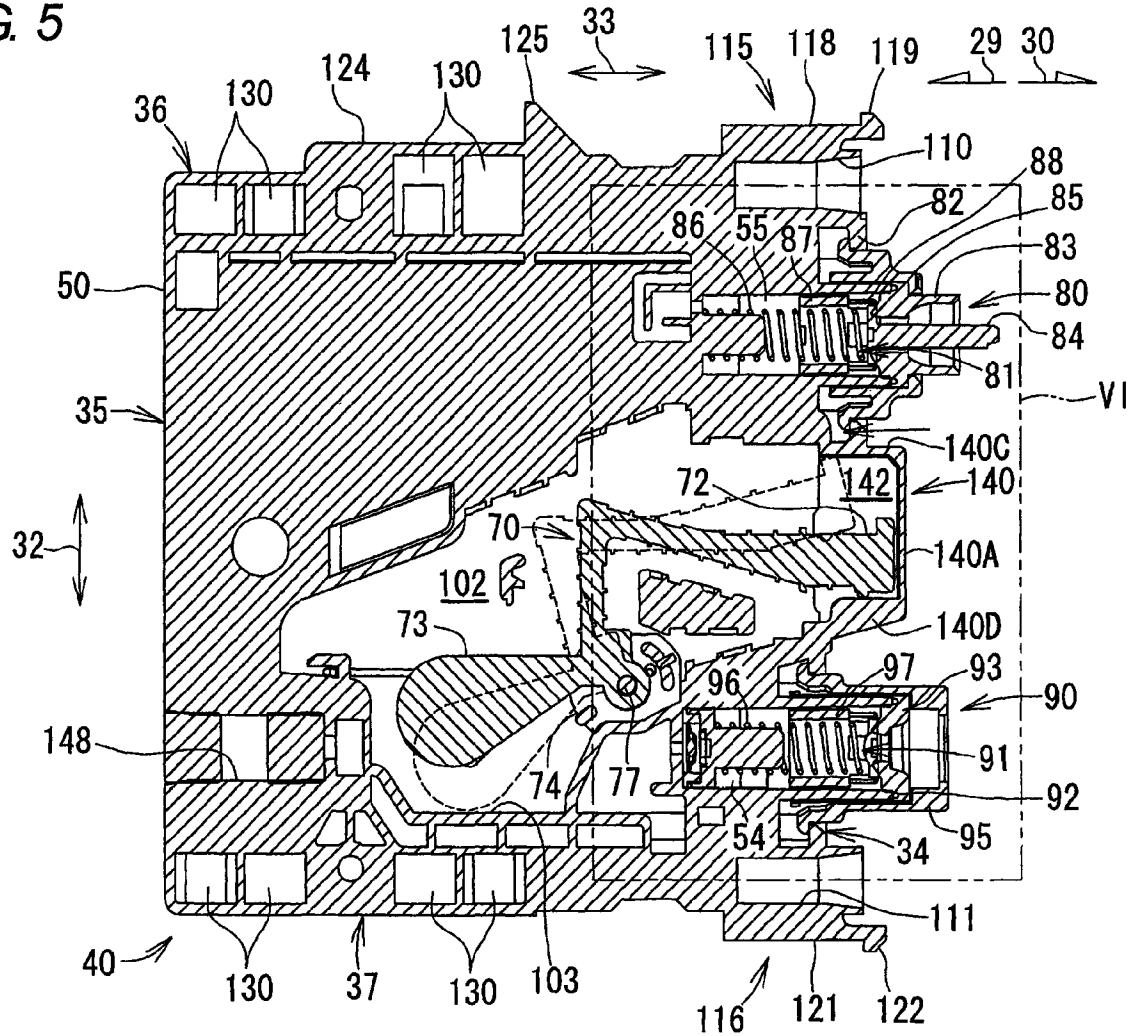
FIG. 5 is a cross-sectional view taken along the line V-V of FIG. 4A.
Figure 6:
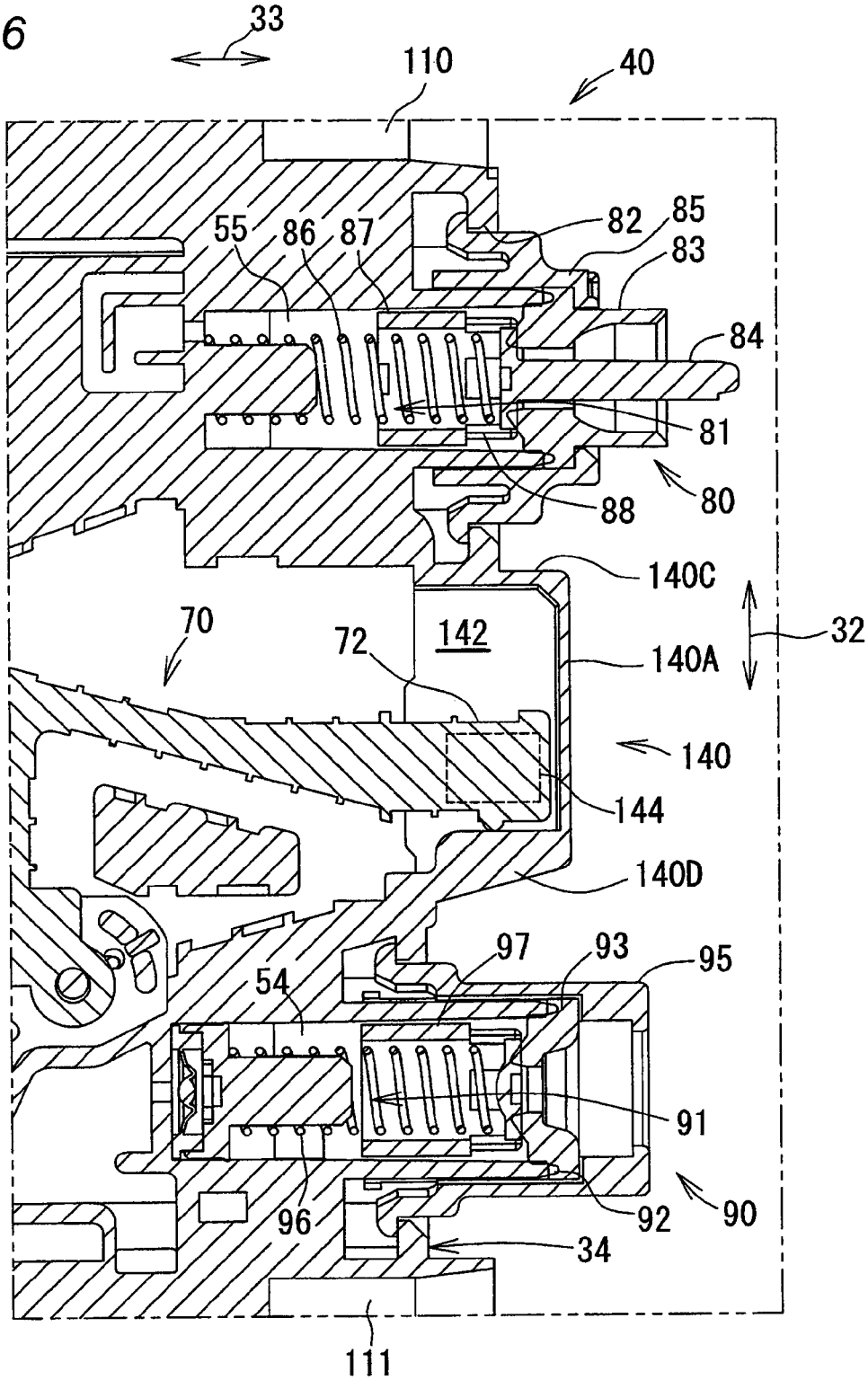
FIG. 6 is an enlarged view illustrating a part of the ink cartridge and the detailed sectional configuration of a portion VI surrounded by a two-dot chain line in FIG. 5.
Figure 7:
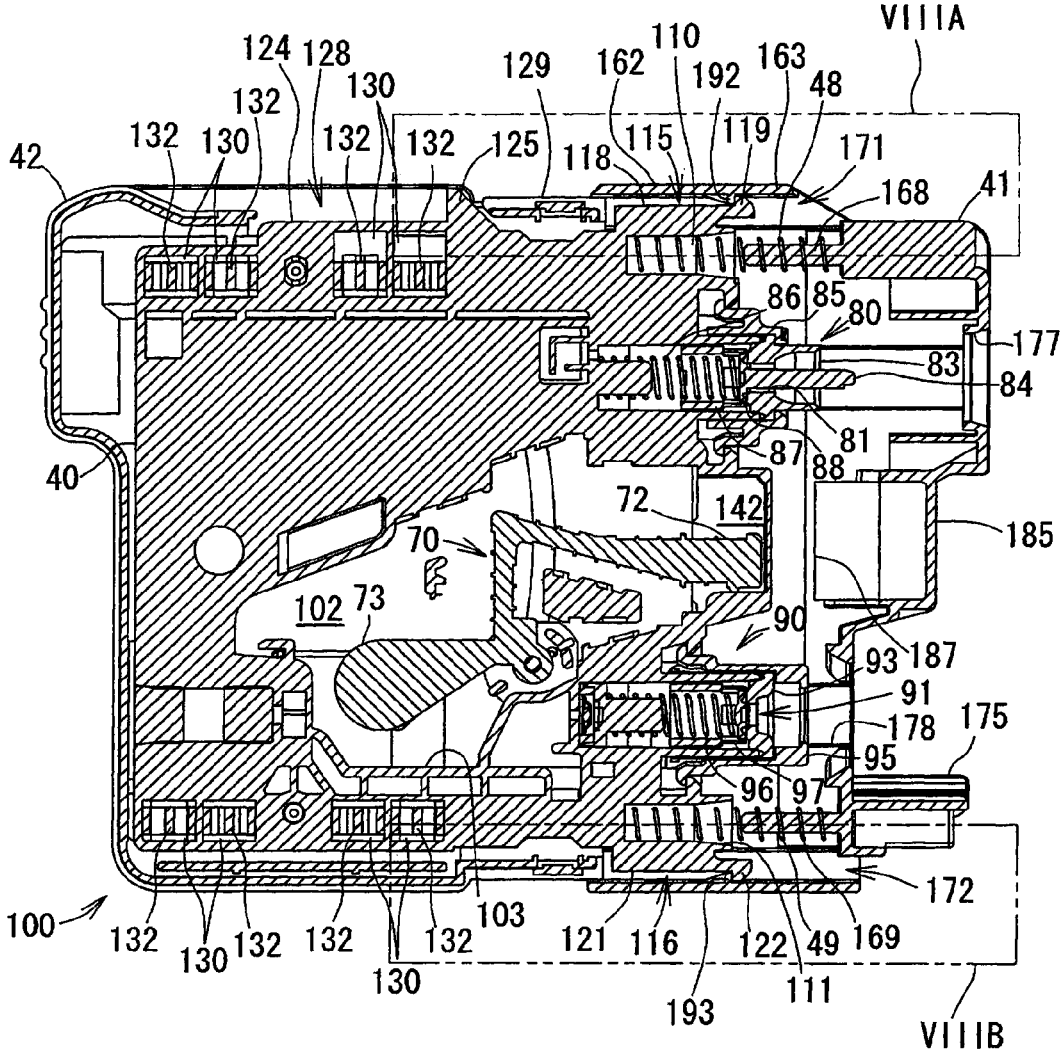
FIG. 7 is a cross-sectional view taken along the line VII-VII of FIG. 2A.
Figure 8A:
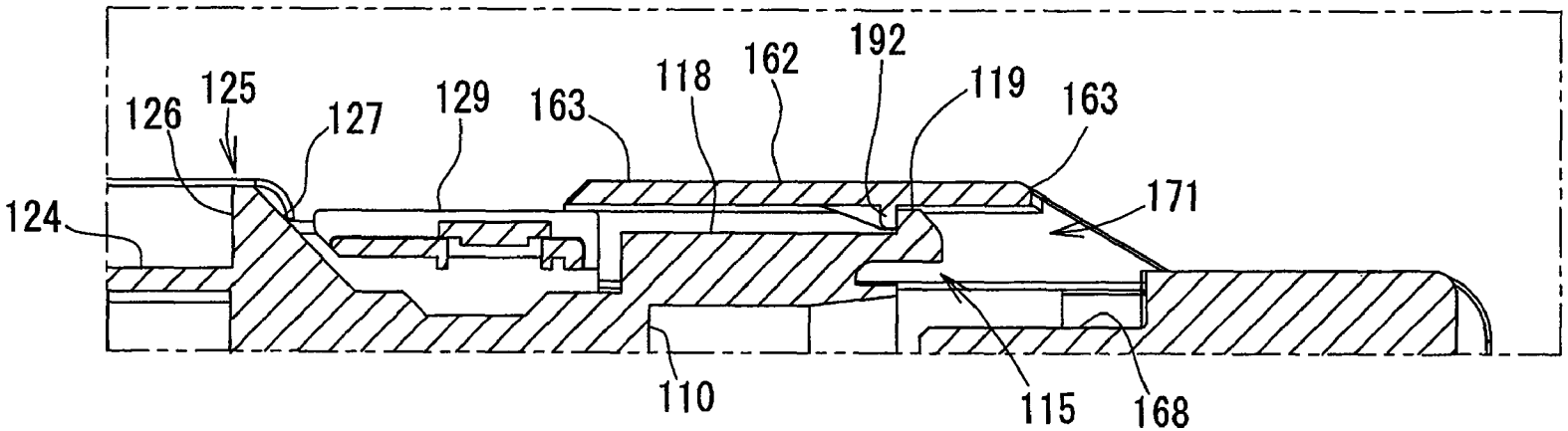
FIGS. 8A and 8B are enlarged cross-sectional views illustrating a part of the ink cartridge, specifically.
Figure 8B:
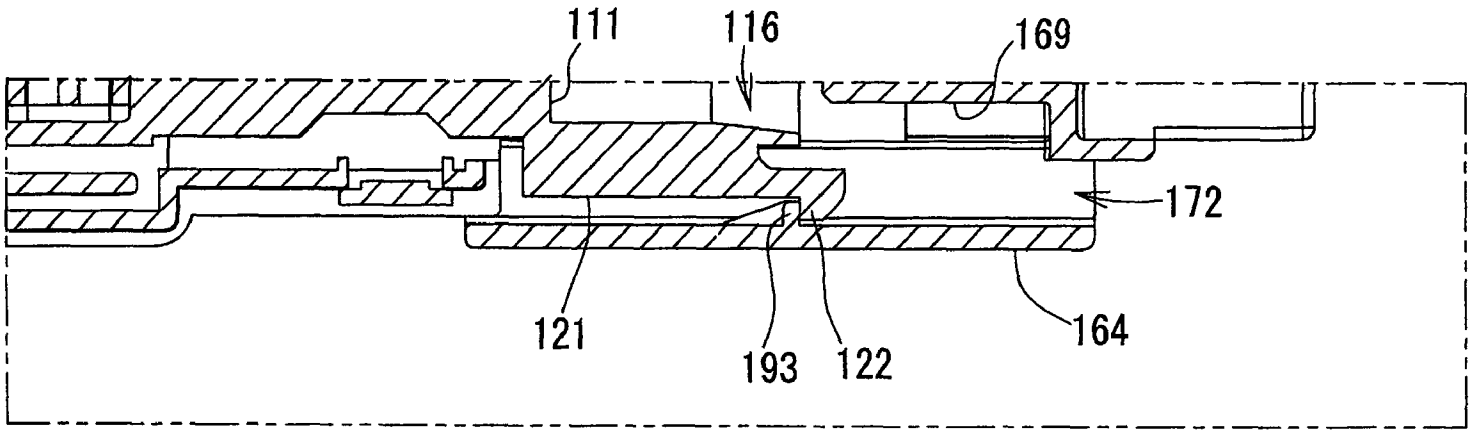
Figure 9:
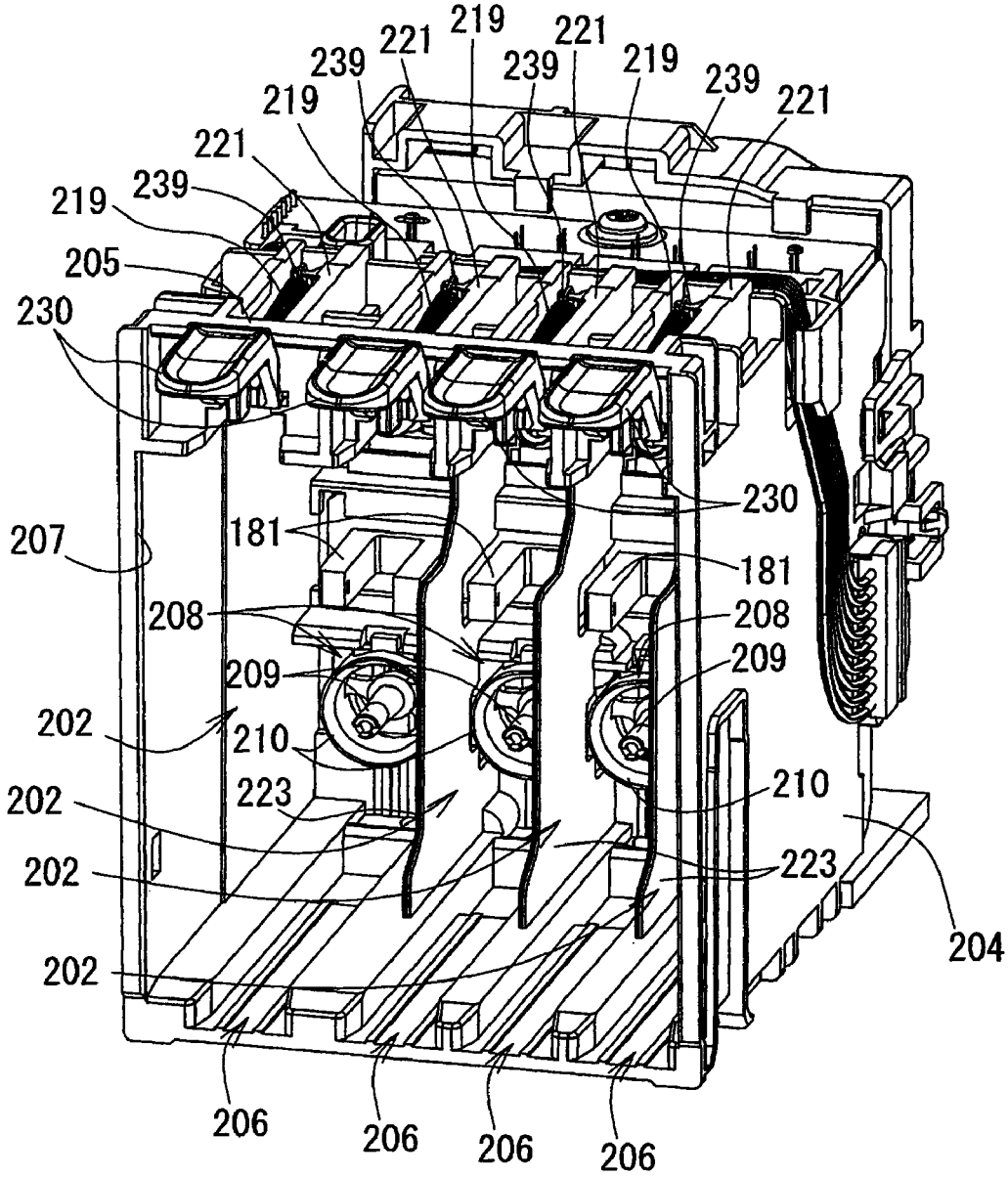
FIG. 9 is a perspective view illustrating the external configuration of a frame of the ink supply device.
Figure 10:
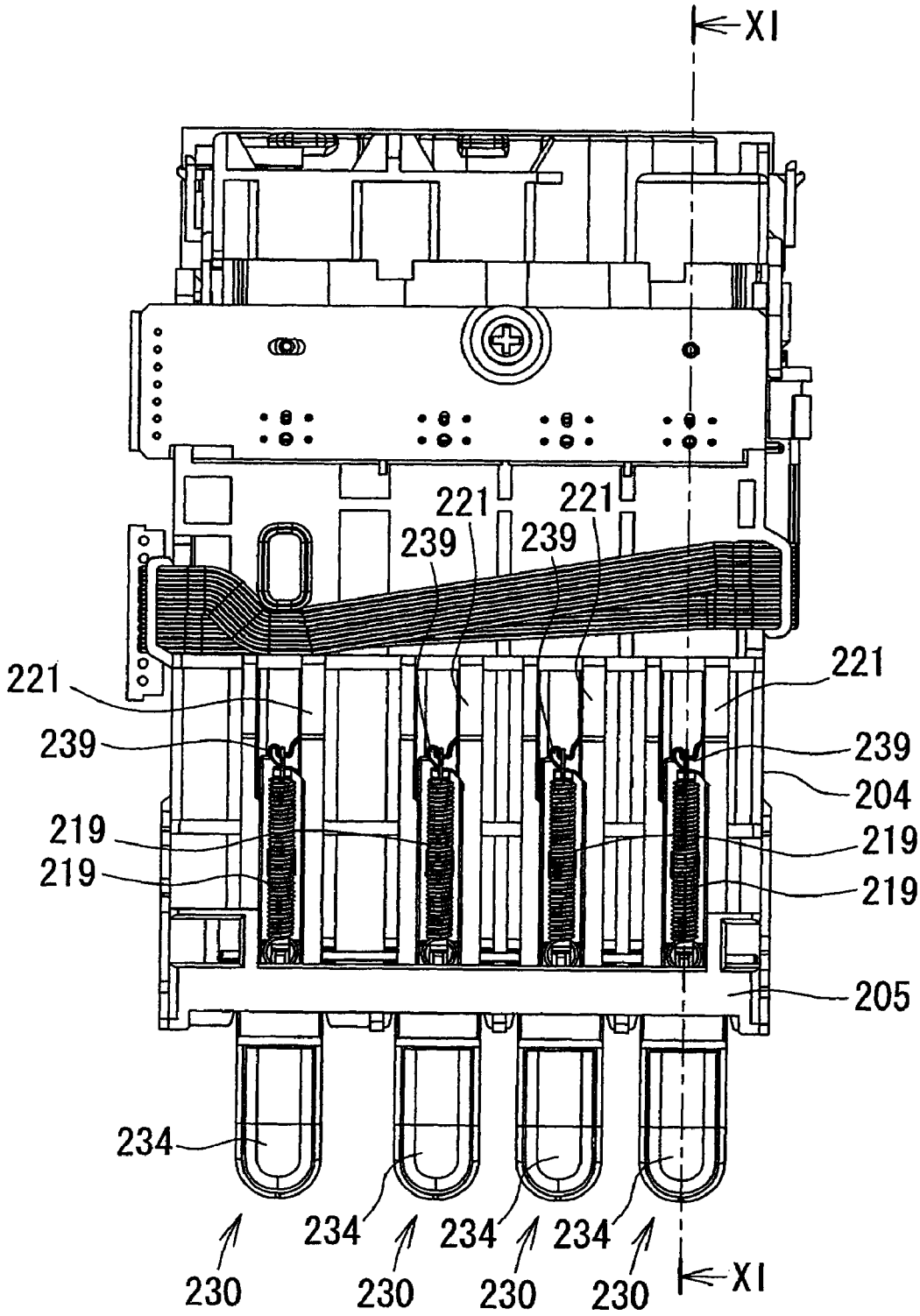
FIG. 10 is a plan view illustrating the external configuration of the frame.
Figure 11:
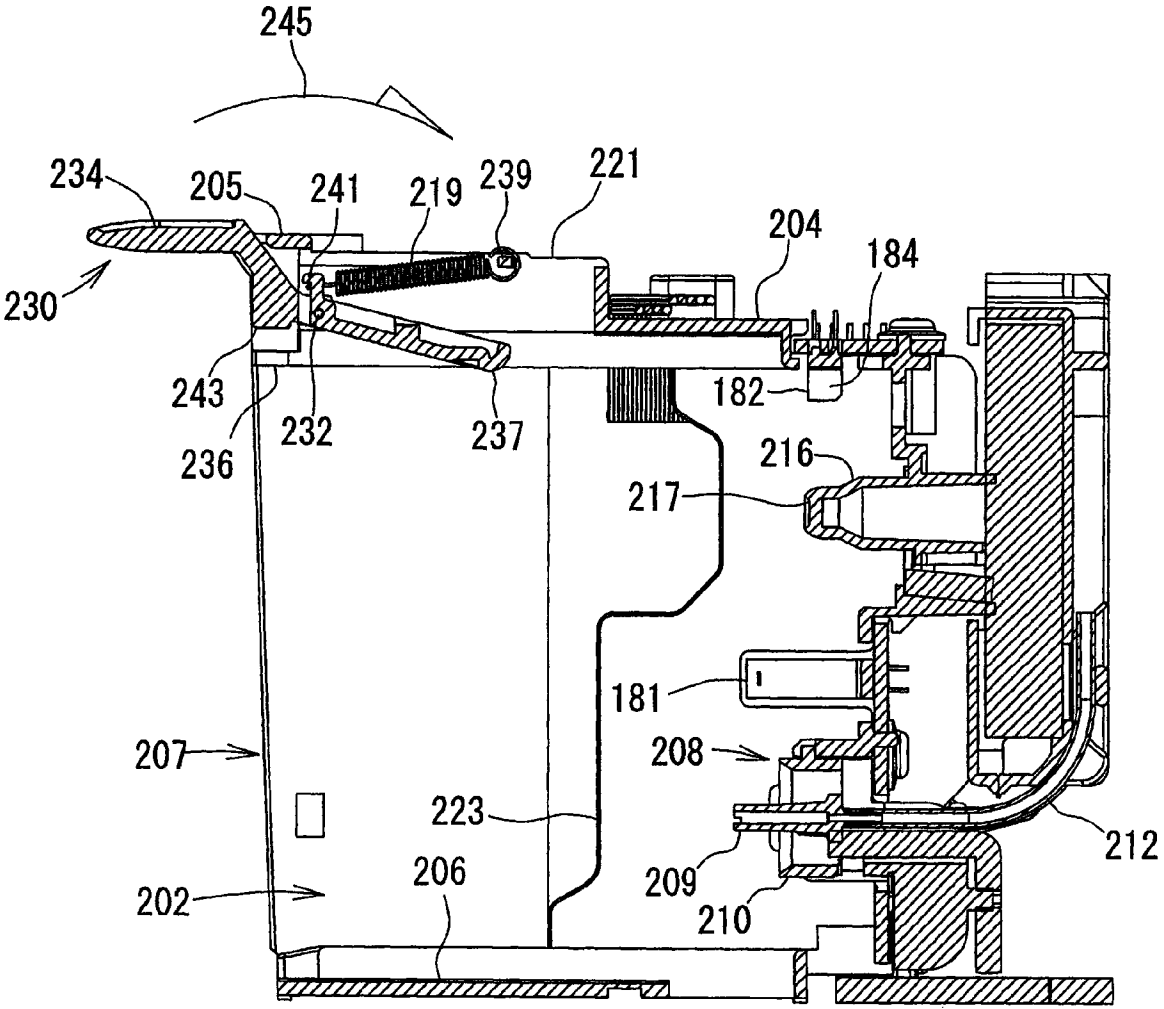
FIG. 11 is a cross-sectional view taken along the line XI-XI of FIG. 10.
Figure 12:
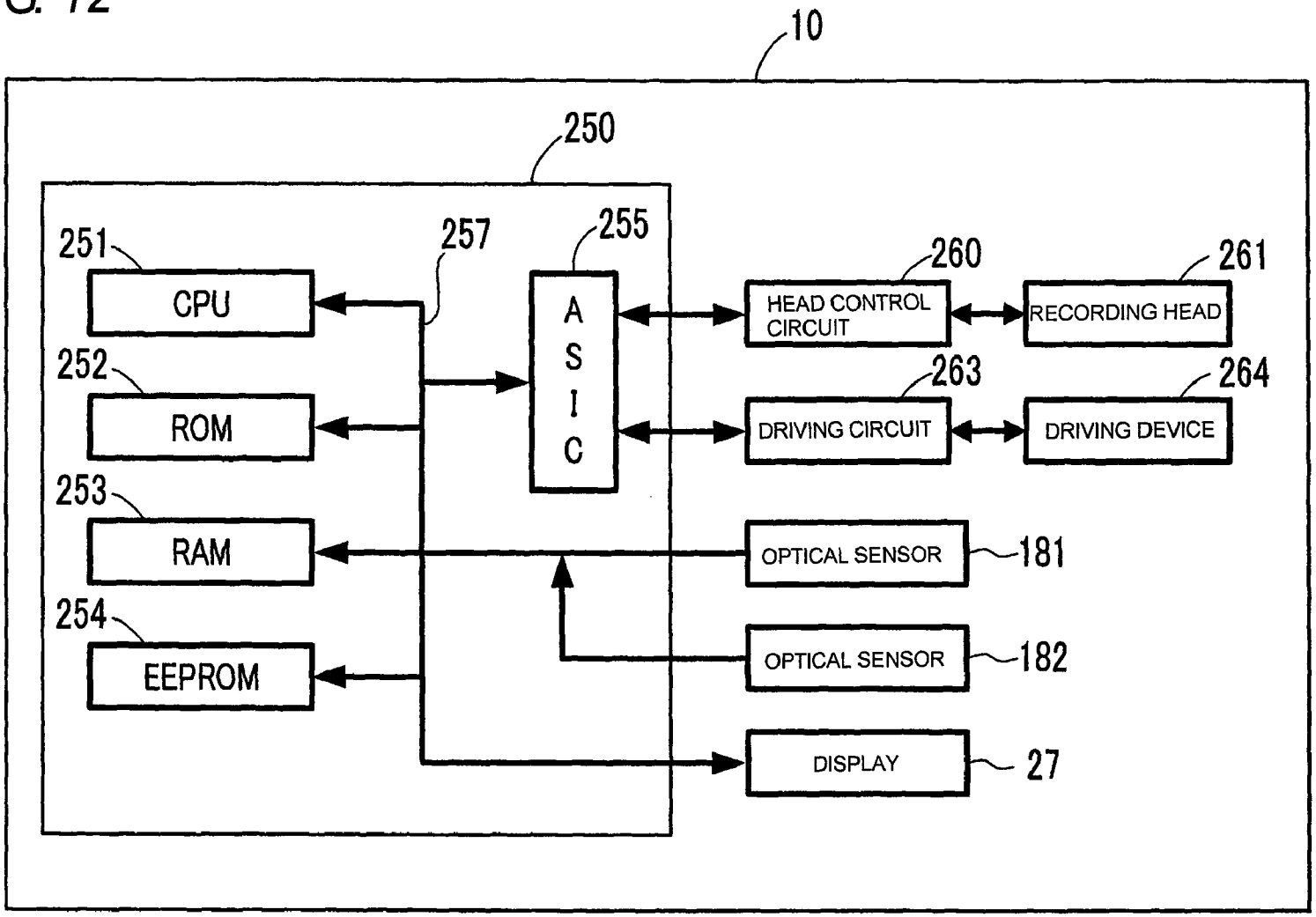
FIG. 12 is a block diagram schematically illustrating the configuration of a main control unit according to an exemplary embodiment.
Figure 13:
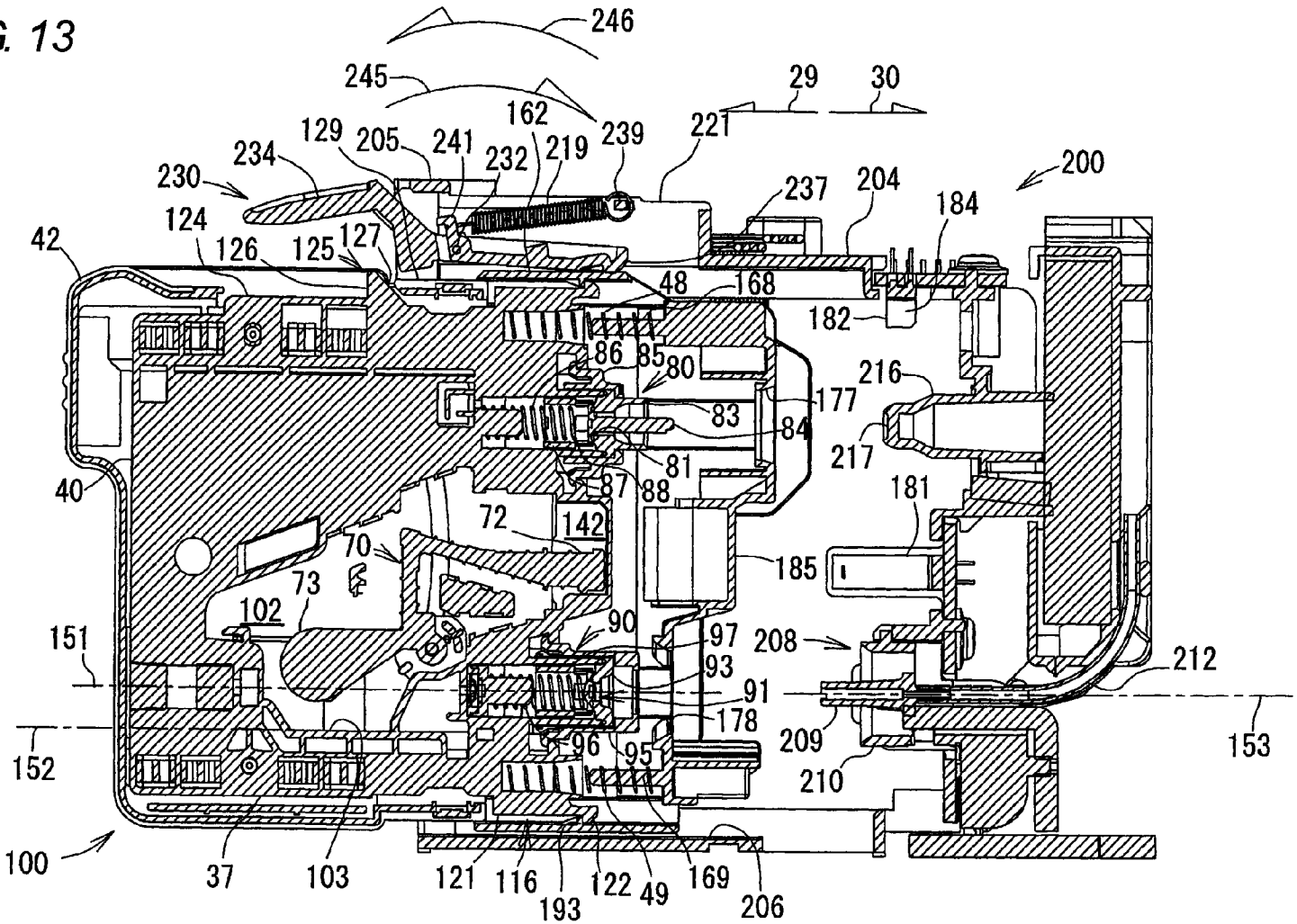
FIG. 13 is a cross-sectional view schematically illustrating the insertion of the ink cartridge into the cartridge mounting portion taken along the line XI-XI.
Figure 14:
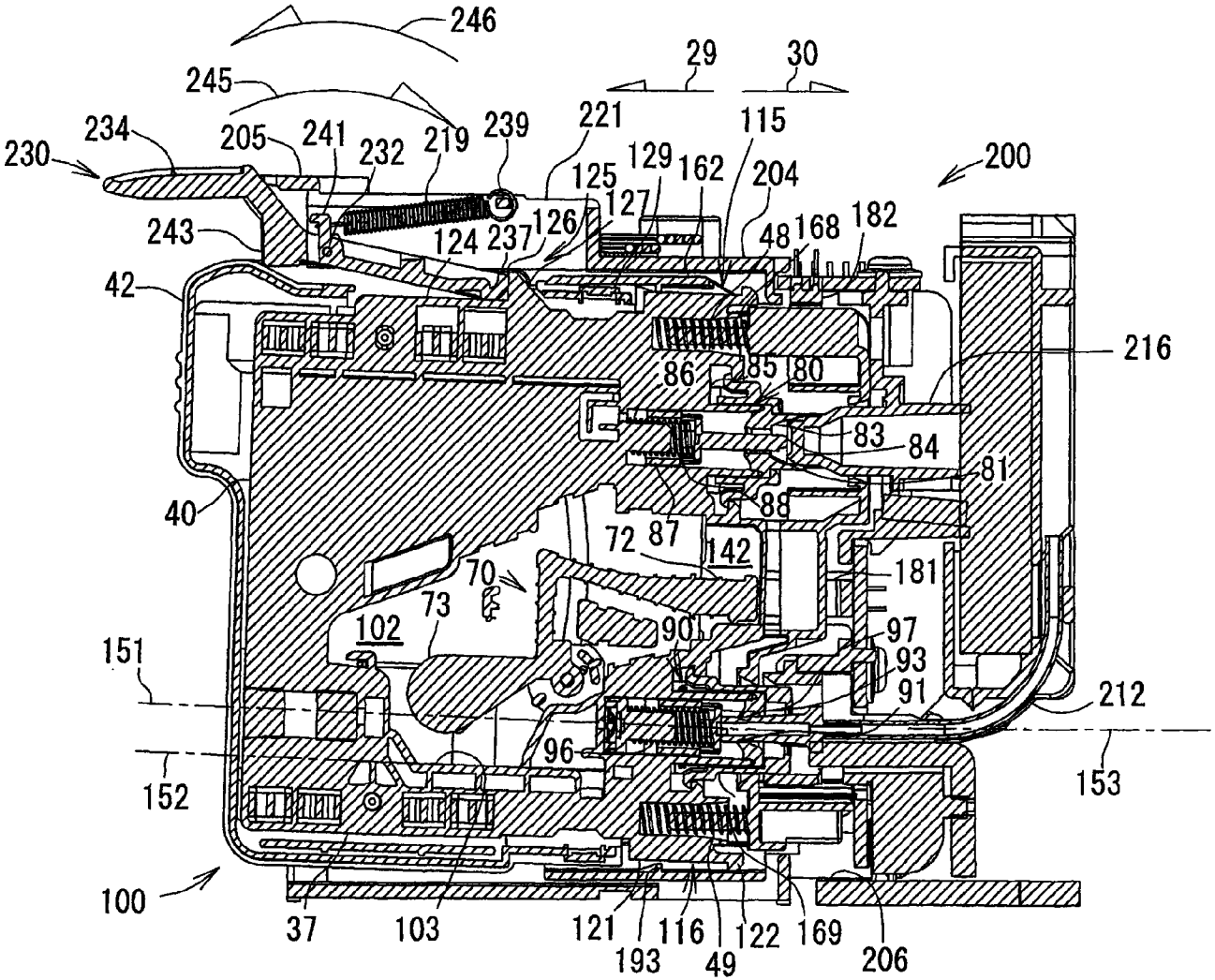
FIG. 14 is a cross-sectional view schematically illustrating the ink cartridge inserted into the cartridge mounting portion taken along the line XI-XI.
Figure 15:
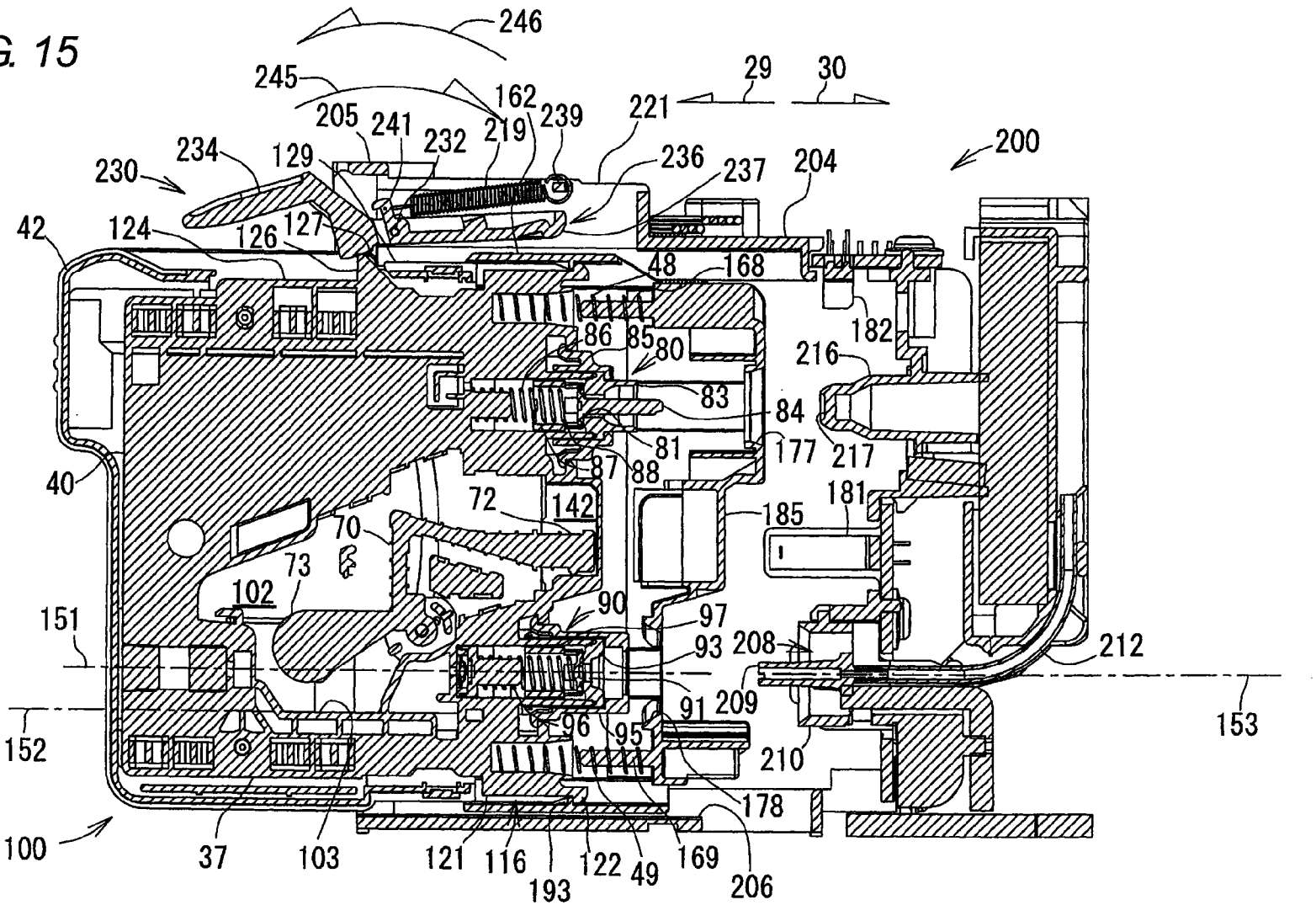
FIG. 15 is a cross-sectional view schematically illustrating the removal of the ink cartridge from the cartridge mounting portion taken along the line XI-XI.

FIG. 1 is a perspective view illustrating the external configuration of an ink supply device 200. FIG. 1 shows a state (inserted state) in which an ink cartridge 100 is inserted into the ink supply device 200. FIGS. 2A and 2B are perspective views illustrating the external configuration of the ink cartridge 100. Specifically, FIG. 2A is a perspective view illustrating a slider 41 disposed at a first position, and FIG. 2B is a perspective view illustrating the slider 41 disposed at a second position. FIGS. 3A and 3B are side views illustrating the ink cartridge 100. Specifically, FIG. 3A is a side view illustrating the slider 41 disposed at the first position, and FIG. 3B is a side view illustrating the slider 41 disposed at the second position. FIGS. 4A and 4B are perspective views illustrating the configuration of a cartridge body 40. Specifically, FIG. 4A is a perspective view illustrating the cartridge body 40, as viewed from a rear surface 34, and 4B is a perspective view illustrating the cartridge body 40, as viewed from a front surface 35. FIG. 5 is a cross-sectional view taken along the line V-V of FIG. 4. FIG. 6 is an enlarged view illustrating a part of the ink cartridge 100, and shows the details of a portion VI surrounded by a two-dot chain line in FIG. 5. FIG. 7 is a cross-sectional view taken along the line VII-VII of FIG. 2A. FIGS. 8A and 8B are enlarged cross-sectional views illustrating a part of the ink cartridge 100. Specifically, FIG. 8A shows the details of a portion VIIIA (the vicinity of an upper part of the slider 41) surrounded by a two-dot chain line in FIG. 7, and 8B shows the details of a portion VIIIB (the vicinity of a lower part of the slider 41) surrounded by a two-dot chain line in FIG. 7. FIG. 9 is a perspective view illustrating the configuration of the ink supply device 200. FIG. 10 is a plan view illustrating the ink supply device 200. FIG. 11 is a cross-sectional view taken along the line XI-XI of FIG. 10. FIG. 12 is a block diagram schematically illustrating the configuration of a main control unit 250. FIGS. 13 to 15 are cross-sectional views schematically illustrating the insertion of the ink cartridge 100 into the cartridge mounting portion 202. FIG. 13 shows the insertion of the ink cartridge 100, FIG. 14 shows the locked state of the ink cartridge 100 after insertion, and FIG. 15 shows the state of the ink cartridge 100 immediately after the ink cartridge is unlocked.

[Schematic Configuration of Ink Supply Device 200]

Next, the schematic configuration of the ink supply device 200 will be described. The ink supply device 200 is applied to, for example, an apparatus that consumes ink (hereinafter, referred to as an 'ink consuming apparatus'), such as an ink-jet printer. The ink supply device 200 may be formed integrally with the ink consuming apparatus. For example, an opening that can be closed up or opened by a cover is formed in a casing of the ink consuming apparatus, and the ink supply device 200 is exposed to the outside through the opening.

The ink supply device 200 includes the ink cartridge 100 and the cartridge mounting portion 202. The ink cartridge 100 is a cartridge type, and can be inserted into or removed from the cartridge mounting portion 202. The ink supply device 200 is configured such that four kinds of ink cartridges 100 can be inserted thereinto or removed therefrom. Each of the ink cartridges 100 stores any one of cyan, magenta, yellow, and black inks. In the ink supply device 200, color inks stored in the ink cartridges 100 inserted into the cartridge mounting portion 202 are supplied to a recording head of the ink-jet printer.

[Ink Cartridge 100]

Next, the detailed configuration of the ink cartridge 100 will be described. As shown in FIGS. 2A to 3B, the ink cartridge 100 has a substantially hexahedral shape. Specifically, the ink cartridge 100 has a substantially rectangular parallelepiped shape that has a small width (in the direction of an arrow 31) and a height (in the direction of an arrow 32) and a depth (in the direction of an arrow 33) that are larger than the width. The ink cartridge 100 is inserted into the cartridge mounting portion 202 in the direction of an arrow 30 (hereinafter, referred to as an 'insertion direction 30') in an erected state shown in FIGS. 2A to 3B, that is, with the bottom thereof facing downward and the top thereof facing upward in the drawings. In this specification, the lower surface and the upper surface of the ink cartridge 100 are defined in the erected state shown in FIGS. 2A to 3B, if they are not particularly specified.

The ink cartridge 100 includes the cartridge body 40 (see FIGS. 4A, 4B) having ink stored therein, the slider 41, a body cover 42, and coil springs 48 and 49 (see FIG. 7). The external configuration of the ink cartridge 100 is substantially formed by the slider 41 and the body cover 42. The cartridge body 40 is substantially covered by the slider 41 and the body cover 42.

The body cover 42 substantially covers the cartridge body 40. A portion of the upper surface 36 (see FIGS. 4A, 4B) of the cartridge body 40 and the rear surface 34 (see FIGS. 4A, 4B) of the cartridge body 40 are exposed from the body cover 42. The slider 41 covers a rear surface portion 46 of the body cover 42 and the rear surface 34 of the cartridge body 40. The rear surface portion 46 of the body cover 42 means a portion of the body cover 42 disposed on the front side in the insertion direction 30. The slider 41 can slide in the depth direction (in the direction of the arrow 33) of the ink cartridge 100 between the first position (see FIG. 2A) that is furthest away from the rear surface 34 (see FIGS. 4A, 4B) of the cartridge body 40 and the second position (see FIG. 2B) that is closest to the rear surface 34 of the cartridge body 40. When the slider 41 is disposed at the second position, a cap 95 (see FIG. 4A) of an ink supply valve 90, which will be described below, protrudes from the slider 41 to the outside. When the slider 41 is disposed at the first position, the cap 95 is inserted into the slider 41. The detailed structures of the cartridge body 40, the body cover 42, and the slider 41 will be described below.

[Cartridge Body 40]

Next, the detailed configuration of the cartridge body 40 will be described. As shown in FIGS. 4A and 4B, the cartridge body 40 has a substantially hexahedral shape. In this exemplary embodiment, as shown in FIGS. 4A, 4B and 5, in the cartridge body 40, a surface on the front side in the insertion direction 30 is the rear surface 34, a surface on the rear side in the insertion direction 30 is the front surface 35, a surface on the upper side in the gravity direction is an upper surface 36, and a surface on the lower side in the gravity direction is a lower surface 37. The rear surface 34 and the front surface 35 are opposite to each other, and are adjacent to the upper surface 36 and the lower surface 37. In addition, two surfaces adjacent to all of the rear surface 34, the front surface 35, the upper surface 36, and the lower surface 37 are side surfaces 38 and 39. The side surfaces 38 and 39 are opposite to each other. As viewed from the front surface 35, the left side is the left side surface 38, and the right side is the right side surface 39. In this embodiment, the rear surface 34, the front surface 35, the upper surface 36, the lower surface 37, the left side surface 38, and the right side surface 39 are all virtual surfaces of the cartridge body 40 in all directions. Actually, the cartridge body 40 has partially uneven portions with respect to all the virtual surfaces. Among the virtual surfaces, the side surfaces 38 and 39 have the largest area.

The cartridge body 40 includes a frame 50, an arm 70, an air communicating valve 80, the ink supply valve 90, and transparent resin films (not shown). The films are adhered to the edges of the two side surfaces 38 and 39 (the left and right surfaces of FIGS. 4A, 4B) of the frame 50. The films form the left side surface 38 and the right side surface 39 of the cartridge body 40. The films are liquid-tightly adhered to the frame 50 to form a space in the frame 50. The inner space of the frame 50 serves as an ink chamber 102.

The frame 50 is a member forming the casing of the body 40. As described above, the frame 50 forms the rear surface 34, the front surface 35, the upper surface 36, the lower surface 37, the left side surface 38, and the right side surface 39 of the cartridge body 40. Therefore, in the following description of the frame 50, reference numerals given to the six surfaces of the cartridge body 40 is used for showing the six surfaces of the frame 50.

The frame 50 is formed of a translucent member, for example, a transparent or translucent resin material. The frame 50 is formed of a resin material by injection molding. Examples of the resin material include polyacetal, nylon, polyethylene, and polypropylene.

As shown in FIGS. 4A and 4B, the frame 50 includes a ring-shaped outer wall 51 and a plurality of inner walls 52. The inner walls 52 are arranged inside the outer wall 51. The outer wall 51 and the inner walls 52 are integrally formed, and have a width from the left side surface 38 to the right side surface 39 of the cartridge body 40. The outer circumferential surface of the ring-shaped outer wall 51 forms the rear surface 34, the upper surface 36, the front surface 35, and the lower surface 37, and openings 57 and 58 are formed in the surfaces of the outer wall corresponding to the left side surface 38 and the right side surface 39, respectively. Two films (not shown) are adhered to the circumferences of the openings 57 and 58. The size of the two films corresponds to that of the outer wall 51, and the films are adhered to liquid-tightly seal the openings 57 and 58. The outer wall 51 and the two films define the ink chamber 102, and predetermined ink is injected and stored in the ink chamber 102. In this exemplary embodiment, the frame 50 and the films form the ink chamber 102, but the present invention is not limited thereto. For example, the frame 50 may be formed in a rectangular parallelepiped shape, and the inner space of the frame may serve as the ink chamber 102. The inner walls 52 are arranged inside the outer wall 51, but the present invention is not limited thereto. The films may be adhered to portions of the inner walls 52 forming the left side surface 38 and the right side surface 39.

As shown in FIGS. 4A, 4B and 5, an ink injection portion 148 is formed in the front surface 35 of the frame 50. The ink injection portion 148 is a hole that has a substantially cylindrical shape and is formed so as to extend from the front surface 35 to the ink chamber 102. The ink injection portion 148 is formed integrally with the frame 50 in the vicinity of the lower end of the front surface 35. The ink injection portion 148 communicates with the ink chamber 102 in the inner rear surface of the frame. Ink flows into the ink chamber 102 through the ink injection portion 148. After ink is injected into the ink chamber 102, the ink injection portion 148 is liquid-tightly sealed by, for example, a rubber stopper.

A detecting window 140 is formed on the rear surface 34 of the frame 50. The detecting window 140 is for visually or optically detecting the amount of ink stored in the ink chamber 102. The detecting window 140 is formed integrally with the frame 50. Therefore, the detecting window 140 is formed of the same material as that forming the frame 50. That is, the detecting window 140 is made of a transparent or translucent material capable of transmitting light. The detecting window 140 can transmit light incident from the outside. A radiation region 144 (a region surrounded by a dashed line in FIG. 6) is formed below the detecting window 140. Light emitted from an optical sensor 181 (see FIG. 9) provided in the cartridge mounting portion 202 is incident on the radiation region 144. The optical sensor 181 is a so-called photo interrupter including a light-emitting element and a light-receiving element. Light emitted from the light-emitting element of the optical sensor 181 is incident on the radiation region 144, and light passing through the radiation region 144 is received by the light-receiving element.

The detecting window 140 protrudes from a middle portion of the rear surface 34 of the cartridge body 40 to the outside of the cartridge body 40. The detecting window 140 has a substantially rectangular parallelepiped shape surrounded by five walls, and has a hollow inner space. The five walls of the detecting portion 140 are a rectangular rear wall 140A that is parallel to the rear surface 34 and is spaced from the rear surface 34 to the outside by a specific distance, a pair of side walls 140B including two sides of the rear wall 140A in the width direction, an upper wall 140C including the upper side of the rear wall 140A, and a lower wall 140D including the lower side of the rear wall 140A. The width of the rear wall 140A (the dimensions of the front wall in the direction of the arrow 31 in FIG. 4) is smaller than that of the rear surface 34.

As shown in FIG. 5, a space 142 surrounded by the rear wall 140A, the side walls 140B, the upper wall 140C, and the lower wall 140D is formed in the detecting window 140. The space 142 communicates with the ink chamber 102. An indicator 72 of the arm 70 provided in the ink chamber 102 is inserted into the space 142. The arm 70 is pivotable such that the indicator 72 is moved substantially in the vertical direction in the space 142.

As shown in FIG. 5, the arm 70 is pivotably supported by a supporting member 74 that is provided substantially at the center of the ink chamber 102 in the depth direction (in the direction of the arrow 33) at a position that is slightly lower than the position of the detecting window 140 in the height direction (in the direction of the arrow 32). The indicator 72 is provided at one end of the arm 70. The indicator 72 enters the space 142, and is moved in the vertical direction in the space 142 when the arm 70 is rotated. A floating portion 73 is provided at the other end of the arm 70. The floating portion 73 has predetermined buoyancy with respect to the ink stored in the ink chamber 102. The buoyancy of the floating portion 73 is adjusted by, for example, the volume of a hollow portion formed in the floating portion 73 or a material forming the floating portion. When ink stored in the ink chamber 102 is consumed, the level of ink in the ink chamber 102 is lowered, and the floating portion 73 is moved (displaced). When the floating portion 73 is displaced, the arm 70 is rotated. The supporting member 74 is formed integrally with the frame 50, and includes a supporting shaft 77 for rotatably supporting the arm 70.

When the amount of ink in the ink chamber 102 is more than a threshold value, the floating portion 73 is moved up. When the floating portion 73 is moved up, the indicator 72 is moved down in the space 142 and is disposed at a light-shielding position that contacts the lower wall 140D (a position represented by a solid line in FIG. 5). The indicator 72 disposed at the light-shielding position shields light that is emitted from the light-emitting element of the optical sensor 181 to the radiation region 144 (a portion represented by a dashed line in FIG. 6) provided at a lower part of the detecting window 140. If the amount of ink in the ink chamber 102 is equal to or less than the predetermined value, the floating portion 73 is moved down with a drop in the level of ink. When the floating portion 73 is moved down, the indicator 72 is moved up in the space 142 and is disposed at a light-transmitting position (a position represented by a dashed line in FIG. 5) that contacts the upper wall 140C of the detecting window 140. The indicator 72 disposed at the light-transmitting position does not shield light that is emitted from the light-emitting element of the optical sensor 181 to the radiation region 144. Therefore, light emitted from the light-emitting element of the optical sensor 181 passes through the radiation region 144 of the detecting window 140 and is then received by the light-receiving element of the optical sensor 181. The optical sensor 181 outputs an electric signal corresponding to the intensity of the light received by the light-receiving element. Therefore, it is determined whether the amount of ink in the ink chamber 102 is more than a threshold value based on the electric signal output from the optical sensor 181.

As shown in FIG. 6, an opening 82 of the valve accommodating chamber 55 is formed at an upper part of the rear surface 34 of the frame 50. The opening 82 is positioned above the detecting window 140 in the height direction (in the direction of the arrow 32), and has a circular shape, as viewed from the rear surface 34. The opening 82 is one end of the valve accommodating chamber 55 having a cylindrical shape that extends from the rear surface 34 to the inside of the frame 50. The valve accommodating chamber 55 extends in the depth direction (in the direction of the arrow 33) of the cartridge body 40, and communicates with the ink chamber 102 in the inner rear surface of the cartridge body. The air communicating valve 80 is accommodated in the valve accommodating chamber 55.

The air communicating valve 80 is a valve that closes or opens an air passage extending from the opening 82 to the ink chamber 102. For example, the air communicating valve 80 includes a valve body 87, a coil spring 86, a seal member 83, and a cap 85. The valve body 87 can slide in the depth direction of the cartridge body 40 in the valve accommodating chamber 55. The valve body 87 includes a cover 88 and a rod 84. The valve body 87 slides between a position where the cover 88 contacts the seal member 83 and a position where the cover 88 is separated from the seal member 83 in the valve accommodating chamber 55. When the cover 88 contacts the seal member 83, an air communicating hole 81, which will be described below, is closed. When the cover 88 is separated from the seal member 83, the air communicating hole 81 is opened. The rod 84 protrudes from the center of the cover 88 to the outside of the frame 50 through the air communicating hole 81 and the opening 82. As shown in FIG. 6, the leading end of the rod 84 is positioned at the outmost side of the center of a member provided on the rear surface 34. In addition, the rod 84 extends substantially in the axial direction of the air communicating hole 81 and the opening 82.

The cap 85 is attached to the opening 82 with the seal member 83 interposed therebetween. The cap 85 and the seal member 83 are provided with through holes (not shown), and the through holes communicate with each other. The through holes of the cap 85 and the seal member 83 form the air communicating hole 81 through which the inside and the outside of the valve accommodating chamber 55 communicate with each other. That is, the air communicating hole 81 is a portion of the air passage extending from the outside of the opening 82 to the ink chamber 102. The rod 84 is inserted into the air communicating hole 81.

The coil spring 86 is provided in the valve accommodating chamber 55, and urges the valve body 87 in the direction in which the air communicating hole 81 is closed. That is, the coil spring 86 urges the valve body 87 in the direction in which the cover 88 is moved to the seal member 83. Therefore, in the air communicating valve 80, when no external force is applied, the coil spring 86 urges the cover 88 to close up the air communicating hole 81. When external force is applied to press the rod 84, the cover 88 of the valve body 87 is separated from the seal member 83 against the urging force of the coil spring 86, and the air communicating hole 81 is opened. In this way, the air layer of the ink chamber 102 becomes the atmospheric pressure.

An opening 92 of the valve accommodating chamber 54 is formed at a lower part of the rear surface 34 of the frame 50. The opening 92 is positioned below the detecting window 140 in the height direction (in the direction of the arrow 32), and has a circular shape, as viewed from the rear surface 34. The opening 92 is one end of the valve accommodating chamber 54 having a cylindrical shape that extends from the rear surface 34 to the inside of the frame 50. The valve accommodating chamber 54 extends in the depth direction (in the direction of the arrow 33) of the cartridge body 40, and communicates with the ink chamber 102 in the inner rear surface of the cartridge body. The ink supply valve 90 is accommodated in the valve accommodating chamber 54.

The ink supply valve 90 is a valve that closes or opens an ink passage extending from the opening 92 to the ink chamber 102. For example, the ink supply valve 90 includes a valve body 97, a coil spring 96, a seal member 93, and a cap 95. The cap 95 is attached to the opening 92 with the seal member 93 interposed therebetween. The cap 95 and the seal member 93 are provided with through holes (not shown), and the through holes communicate with each other. The through holes form the ink supply port 91 through which the inside and the outside of the valve accommodating chamber 54 communicate with each other. When the ink cartridge 100 is inserted into the cartridge mounting portion 202, a tubular ink needle 209 (see FIG. 9) is inserted into the ink supply port 91.

As shown in FIG. 5, the ink supply port 91 is provided in the vicinity of the lower surface 103 of the ink chamber 102. The lower surface 103 of the ink chamber 102 is a surface of the ink chamber that is arranged on the lower side in the gravity direction in the erected state of the ink cartridge shown in FIGS. 4A, 4B and 5, and is formed by the inner surface of the outer wall 51. As shown in the drawings, ink flows through the ink supply port 91 substantially in the horizontal direction in the erected state of the ink cartridge 100. In addition, the lower surface 103 forms a substantially horizontal plane of the erected ink cartridge 100.

The coil spring 96 is provided in the valve accommodating chamber 54, and urges the valve body 97 in the direction in which the ink supply port 91 is closed. That is, the coil spring 96 urges the valve body 97 in the direction in which the valve body is moved to the seal member 93. Therefore, in the ink supply valve 90, when no external force is applied, the valve body 97 comes into close contact with the seal member 93 to seal the ink supply portion 91. On the other hand, when the ink needle 209 is inserted into the ink supply port 91 from the outside, the leading end of the ink needle 209 presses the valve body 97, and the valve body 97 is separated from the seal member 93 against the urging force of the coil spring 96. At the same time, the ink supply port 91 is liquid-tightly sealed by the outer circumferential surface of the ink needle 209. Then, ink stored in the ink chamber 102 flows to the leading end of the ink needle 209 that is positioned closer to the inside than the ink support port 91, and then supplied to a recording head of an ink consuming apparatus, such as an ink-jet printer, through the ink needle 209.

As shown in FIG. 5, a spring accommodating chamber 110 is formed above the valve accommodating chamber 55 on the rear surface 34 of the frame 50. In addition, a spring accommodating chamber 111 is formed below the valve accommodating chamber 54 on the rear surface 34 of the frame 50. The spring accommodating chambers 110 and 111 are substantially cylindrical holes formed from the rear surface 34 of the frame 50 to the ink chamber 102. Coil springs 48 and 49 (see FIG. 7) are accommodated in the spring accommodating chambers 110 and 111, respectively. The coil springs 48 and 49 urge the slider 41 in the insertion direction 30. The positions of the spring accommodating chambers 110 and 111, or the inside diameters or the depths of the holes depend on the specifications of the springs. However, it is advantageous that a pair of spring accommodating chambers 110 and 111 be vertically arranged so as to be spaced from each other in the height direction of the cartridge body 40, in order to uniformly urge the slider 41 elongated in the height direction (in the direction of the arrow 32) of the cartridge body 40 such that the slider is stably disposed relative to the cartridge body 40, as in this exemplary embodiment. The operation of the coil spring 86 of the air communicating valve 80, the coil spring 96 of the ink supply valve 90, and the coil springs 48 and 49 will be described below.

As shown in FIG. 5, a supporting member 115 is provided on the front side of the upper surface 36 of the frame 50 in the insertion direction 30. In addition, a supporting member 116 is provided on the front side of the lower surface 37 of the frame 50 in the insertion direction 30. The supporting members 115 and 116 are formed integrally with the frame 50. The supporting members 115 and 116 are respectively engaged with protruding pieces 192 and 193 (see FIG. 8) formed on the slider 41, and support the slider 41 so as to be slidable relative to the cartridge body 40. The supporting members 115 and 116 are engaged with the slider 41 to prevent the slider 41 from being detached from the cartridge body 40.

Specifically, the supporting member 115 includes a base 118 that vertically protrudes from the upper surface 36 of the frame 50 upward and a hooking portion 119 that is formed at one end of the base 118 close to the rear surface 34. The hooking portion 119 has a hook shape that is bent upward in the insertion direction 30. The supporting member 116 includes a base 121 that vertically protrudes from the lower surface 37 of the frame 50 downward and a hooking portion 122 that is formed at one end of the base 121 close to the rear surface 34. The hooking portion 122 has a hook shape that is bent downward in the insertion direction 30. The bases 118 and 121 make it possible to guide the sliding of the slider 41 relative to the cartridge body 40 in a predetermined direction. The hooking portions 119 and 122 prevent the slider 41 from being detached from the cartridge body 40.

As shown in FIGS. 4A, 4B and 5, a table portion 124 is provided on the upper surface 36 of the frame 50. The table portion 124 protrudes from the upper surface 36 upward. In addition, the table portion 124 extends from a middle portion of the upper surface 36 in the depth direction (in the direction of the arrow 33) backward in the insertion direction 30, that is, toward the front surface 35 of the cartridge body 40. When the cartridge body 40 is covered with the body cover 42, the table portion 124 is exposed to the outside through an opening 128 (see FIGS. 2A, 2B) formed in the upper surface of the body cover 42.

A stopper 125 is provided on the table portion 124. The stopper 125 is provided at the leading end (the right side of FIG. 5) of the table portion 124 in the insertion direction 30, and protrudes from the upper surface of the table portion 124 upward. As shown in FIG. 4, the stopper 125 includes a vertical wall 126 that is vertical with respect to the upper surface of the table portion 124 and a rib 127 that is inclined from the top of the vertical wall 126 downward to the front side of the upper surface in the insertion direction 30 at an angle of about 45°. When the ink cartridge 100 is inserted into the cartridge mounting portion 202, the stopper 125 is used to lock the ink cartridge 100 such that the ink cartridge 100 is not removed from the cartridge mounting portion 202. The ink cartridge 100 is locked by engagement between the stopper 125 and a lock portion 237 (see FIG. 12) of a lock arm 230, which will be described below.

As shown in FIG. 5, a plurality of through holes 130 are formed in the frame 50. The through holes 130 are formed in the frame 50 in the width direction (in the direction that is vertical to the plane of FIG. 5) thereof In the frame 50, four through holes are formed in each of the upper surface 36 and the lower surface 37. Engaging claws 132 (see FIG. 7) of the body cover 42 are engaged with the through holes 130 to couple the cartridge body 40 and the body cover 42.

[Slider 41 and Body Cover 42]

Next, the detailed configuration of the slider 41 and the body cover 42 will be described. As shown in FIGS. 2A to 3B, the body cover 42 is formed in the shape of a container capable of substantially accommodating the cartridge body 40, with a portion of the rear surface 34 being exposed. The body cover 42 has a substantially parallelepiped shape corresponding to the shape of the cartridge body 40.

A step portion 43 is formed substantially at the center of the side surface of the body cover 42 in the depth direction (in the direction of the arrow 33). The side surface of the body cover 42 is divided into a front portion 47 that is close to the front surface 35 of the ink cartridge 100 and a rear portion 46 that is close to the rear surface 34 by the step portion 43. The length of the rear portion 46 is smaller than that of the front portion 47 in the width direction (in the direction of the arrow 31), which causes the side surface of the body cover 42 to be uneven. The step portion 43 is an inclined plane, which is a boundary between two convex portions, and extends from the upper end of the body cover 42 to the lower end thereof in an arc shape having its center on the front surface 35 (see FIG. 4) of the cartridge body 40.

As shown in FIGS. 2A, 2B and 7, the opening 128 is formed in the upper surface of the front portion 47 of the body cover 42. The opening 128 is a rectangular hole having a sufficient size to expose the table portion 124 and the stopper 125 of the cartridge body 40. When the body cover 42 is coupled to the cartridge body 40, the table portion 124 and the stopper 125 are exposed to the outside through the opening 128.

As shown in FIGS. 2A to 3B, a guide surface 129 is provided in a portion of the upper surface of the body cover 42 extending from the opening 128 to the rear surface 34. The guide surface 129 is connected to the rib 127 of the stopper 125 exposed through the opening 128, and is substantially flat in the insertion direction 30. The slider 41 is mounted so as to cover the guide surface 129.

As shown in FIGS. 2A and 2B, the body cover 42 includes a pair of left and right covers 44 and 45 that are symmetric with respect to the width direction (the direction of the arrow 31). Each of the left cover 44 and the right cover 45 has a plurality of engaging claws 132 (see FIG. 7) that protrude substantially in the horizontal direction. The engaging claws 132 are engaged with the through holes 130 of the cartridge body 40 with the cartridge body 40 interposed therebetween. In this way, the cartridge body 40, the left cover 44, and the right cover 45 are integrated into one.

The slider 41 is formed in the shape of a container capable of accommodating the rear portion 46 of the body cover 42, and has a flat appearance. Specifically, the slider 41 includes a rear wall 161 corresponding to the rear surface 34 of the cartridge body 40, an upper wall 163 corresponding to the upper surface of the rear portion 46 of the body cover 42, a lower wall 164 corresponding to the lower surface of the rear portion 46, and left and right side walls 165 and 166 corresponding to both side surfaces of the rear portion 46. The rear portion 46 of the body cover 42 is accommodated in the inner space of the slider 41 surrounded by the walls. In addition, the rear portion 46 of the body cover 42 serves as a guide, and the slider 41 slides in the depth direction (the direction of the arrow 33).

The slider 41 includes a detected portion 185 for detecting the kind of ink cartridge 100, a detected portion 186 for detecting whether the ink cartridge 100 is inserted, a cutout 187, rods 168 and 169 (see FIG. 7), a sliding groove 171, a sliding groove 172 (see FIG. 7), an opening 177, an opening 178, and a protruding portion 175.

As shown in FIGS. 2A to 3B, the cutout 187 is formed in the middle of the rear wall 161. The cutout 187 serves as a window through which the detecting window 140 of the cartridge body 40 is exposed to the outside. Therefore, the cutout 187 is formed so as to correspond to the positions, dimensions, and shapes of the rear wall 140A and the side wall 140B of the detecting window 140. Specifically, the cutout 187 is formed by cutting out the side walls 165 and 166 in a rectangular shape in the width direction (in the direction of the arrow 31) such that portions of the side walls close to the rear wall 161 remain. The cutout 187 transmits light emitted from the light-emitting element of the optical sensor 181 (see FIG. 9).

The detected portion 185 is detected by the optical sensor 181, when the ink cartridge 100 is inserted into the cartridge mounting portion 202. Similarly, the detected portion 186 is detected by the optical sensor 182, when the ink cartridge 100 is inserted into the cartridge mounting portion 202. It is possible to determine the kind of ink cartridge 100 based on the detection signals obtained from the detected portions 185 and 186. However, since the detecting method is not directly related to the present invention, a detailed description thereof will be omitted.

As shown in FIG. 7, the rods 168 and 169 are provided in the slider 41. The rods 168 and 169 protrude from the inner surface of the rear wall 161 of the slider 41 to the rear surface 34 of the cartridge body 40 substantially in the horizontal direction. The rod 168 is provided at an upper part of the rear wall 161, and the rod 169 is provided at a lower part of the rear wall 161. The coil spring 48 arranged in the spring accommodating chamber 110 of the cartridge body 40 is fitted to the rod 168, and the coil spring 49 arranged in the spring accommodating chamber 111 of the cartridge body 40 is fitted to the rod 169. When the coil springs 48 and 49 are compressed, the rods 48 and 49 are inserted into the spring accommodating chambers 110 and 111, respectively.

As shown in FIG. 7, the sliding groove 171 is formed in the rear surface of the upper wall 163 of the slider 41. The sliding groove 171 is formed by the upper wall 163, a portion of the left side wall 165, and a portion of the right side wall 166, and has an inverted U-shape having an opened lower surface in a longitudinal sectional view. In addition, a portion of the sliding groove 171 close to the rear wall 161 is opened. In the sliding groove 171, the protruding piece 192 vertically protrudes from the rear surface of the upper wall 163 downward. Most of the supporting member 115 can slide relative to the protruding piece 192, however, the hooking portion 119 of the supporting member 115 contacts the protruding piece 192. The hooking portion 119 contacts the protruding piece 192 from the side of the rear wall 161. The contact prevents the slider 41 from being detached from the cartridge body 40, and the slider 41 can slide relative to the cartridge body 40 in a region where the hooking portion 119 does not contact the protruding piece 192.

Similarly, the sliding groove 172 is formed in the rear surface of the lower wall 164 of the slider 41. The sliding groove 172 is formed by the lower wall 164, a portion of the left side wall 165, and a portion of the right side wall 166, and has a U-shape having an opened upper surface in a longitudinal sectional view. In addition, a portion of the sliding groove 172 close to the rear wall 161 is opened. In the sliding groove 172, the protruding piece 193 vertically protrudes from the rear surface of the lower wall 164 upward. Most of the supporting member 116 can slide relative to the protruding piece 193, however, the hooking portion 122 of the supporting member 116 contacts the protruding piece 193. The hooking portion 122 contacts the protruding piece 193 from the side of the rear wall 161. The contact prevents the slider 41 from being detached from the cartridge body 40, and the slider 41 can slide relative to the cartridge body 40 in a region where the hooking portion 122 does not contact the protruding piece 193. The protruding pieces 192 and 193 are disposed at the same position in the depth direction (in the direction of the arrow 33) of the slider 41. Therefore, the slide position of the slider 41 where the hooking portion 119 contacts the protruding piece 192 is the same as the slide position of the slider 41 where the hooking portion 122 contacts the protruding piece 193 in the direction of arrow 33.

With the slider 41 being mounted to the cartridge body 40, the slider 41 is urged by the coil springs 48 and 49 in the direction in which the slider 41 is separated from the rear surface 34 of the cartridge body 40. When no external force is applied to the slider 41, the protruding pieces 192 and 193 contact the hooking portions 119 and 122, respectively, and the slider 41 is disposed at the first position shown in FIG. 2A. On the other hand, when external pressing force is applied to the slider 41 from the rear wall 161, the slider 41 slides to the second position shown in FIG. 2B against the urging force of the coil springs 48 and 49.

As shown in FIGS. 2A to 3B, a portion of the upper surface of the upper wall 163 of the slider 41 serves as the guide surface 162. The guide surface 162 extends from the end of the opening formed in the upper wall 163 of the slider 41 to the opening of the sliding groove 171, and is substantially horizontal in the ink cartridge 100 in the erected state. When the slider 41 is mounted so as to accommodate the rear portion 46 of the body cover 42, a portion of the guide surface 129 of the body cover 42 is covered by the upper wall 163 of the slider 41. The area of the upper wall 163 covering the guide surface 129 depends on the position (the first position or the second position) of the slider 41. Although a step portion corresponding to the thickness of the upper wall 163 is formed between the guide surface 129 of the body cover 42 and the guide surface 162 of the slider 41, the guide surface 129 and the guide surface 162 are substantially continuous in the horizontal direction.

As shown in FIGS. 2A, 2B and 7, the opening 177 is formed at an upper part of the rear wall 161 of the slider 41. When the slider 41 is mounted to the cartridge body 40, the height of the opening 177 corresponds to that of the air communicating valve 80. The opening 177 has a circular shape, as viewed from the rear wall 161, and has a sufficient size to allow a pressing portion 216 (see FIG. 11) provided in the cartridge mounting portion 202 to pass through. When the ink cartridge 100 is inserted into the cartridge mounting portion 202, the pressing portion 216 is inserted into the opening 177.

The opening 178 is formed at a lower part of the rear wall 161 of the slider 41. When the slider 41 is mounted to the cartridge body 40, the height of the opening 178 corresponds to that of the ink supply valve 90. The opening 178 has sufficient size and shape for the cap 95 of the ink supply valve 90 to pass through. When the slider 41 is disposed at the second position, the cap 95 is exposed to the outside through the opening 178.

[Cartridge Mounting Portion 202]

Next, the detailed configuration of the cartridge mounting portion 202 will be described with reference to FIGS. 9 to 11. As shown in FIG. 9, the cartridge mounting portion 202 includes a frame 204 having a substantially rectangular parallelepiped shape having an opening 207 formed in the front surface thereof The ink cartridges 100 are accommodated in the internal space of the frame 204. In this exemplary embodiment, the cartridge mounting portion 202 has a space corresponding to each ink cartridge 100. That is, four cartridge mounting portions 202 are arranged in a line in the width direction (in the left-right direction of FIG. 9), and four ink cartridges 100 corresponding to cyan, magenta, yellow, and black can be inserted into the cartridge mounting portions 202. The width direction in which the cartridge mounting portions 202 are arranged in a line is the horizontal direction that is orthogonal to the insertion direction 30 of the ink cartridge 100.

As shown in FIGS. 9 and 11, three plates 223 that partition the inner space into four longitudinal spaces are provided in the frame 204. The ink cartridges 100 are accommodated in four spaces (cartridge mounting portions 202) partitioned by the plates 223, respectively. The plates 223 are thin plates that protrude from the inner rear surface of the frame 204 to the front surface, and the front and rear surfaces of the plates 223 vertically extend in the inner space of the frame 204. The plates 223 are arranged in parallel to each other in the width direction (the left-right direction of FIG. 9) of the frame 204 at specific intervals. The gap between the inner surface of the frame 204 and the plate 223 or the gap between a pair of adjacent plates 223 corresponds to the width of the ink cartridge 100 to be inserted between the plates.

The ink cartridges 100 are inserted into the cartridge mounting portions 202, which are spaces partitioned by the frame 204 and the plates 223. The ink cartridge 100 is inserted into the cartridge mounting portion 202 from the rear surface 34. The length of the inner surface of the frame 204 in the vertical direction is slightly larger than the height of the ink cartridge 100 (the length of the ink cartridge in the direction of the arrow 32). The difference in height between the ink cartridge 100 and the frame 204 is generally called backlash or tolerance. The backlash allows the ink cartridge 100 inserted into the cartridge mounting portion 202 to be movable between a first posture and a second posture, which will be described below, in the cartridge mounting portion 202.

Four guide grooves 206 are formed in the bottom of the frame 204. Each of the guide grooves 206 is provided between the inner surface of the frame 204 and the plate 223 or between a pair of adjacent plates 223 so as to extend in a straight line from the front surface of the frame 204 to the inner rear surface of the frame 204. The ink cartridges 100 inserted into each space of the frame 204 are guided from the front surface to the inner rear surface of the frame 204 by the guide grooves 206 in an insertion direction. The insertion direction is aligned with the insertion direction 30 of the ink cartridge 100.

Joints 208 are formed on the inner rear surface of the frame 204. The joints 208 are connected to the ink supply ports 91 of the ink cartridges 100 to drain ink from the ink chambers 102, respectively. Therefore, four joints 208 are provided to correspond to four ink cartridges 100 inserted into the cartridge mounting portions 202. Since four ink cartridges 100 are inserted into the frame 204 in the width direction thereof, the four joints 208 are also arranged in the width direction of the frame 204, and the height of each of the joints 208 corresponds to the height of the ink supply port 91 of corresponding ink cartridges 100 inserted into the cartridge mounting portions 202. In FIG. 9, the rightmost joint 208 is concealed by the frame 204.

Each of the joints 208 includes the ink needle 209 and a holding portion 210. The ink needle 209 is a cylindrical tube made of resin, and protrudes from the inner rear surface of the frame 204 to the front surface substantially in the horizontal direction. The leading end of the ink needle 209 is opened. The leading end of the ink needle is inserted into the ink supply valve 90 of the ink cartridge 100, and the ink supply valve 90 is opened. As shown in FIG. 11, the base of the ink needle 209 is connected to an ink tube 212 on the rear surface of the frame 204. Although the ink tube 212 is cut at its middle part in FIG. 11, actually, the ink tube 212 extends up to an ink consuming apparatus.

The holding portion 210 is a cylindrical member that is provided on the inner rear surface of the frame 204 so as to surround the base of the ink needle 209. The axis of the holding portion 210 is substantially aligned with the axis 153 of the ink needle 209. When the ink cartridge 100 is inserted into the cartridge mounting portion 202, the cap 95 (see FIG. 2B) is fitted into the holding portion 210, and the ink needle 209 is inserted into the ink supply port 91 of the ink supply valve 90.

As shown in FIG. 11, the pressing portions 216 are provided on the inner rear surface of the frame 204. The height of the pressing portion 216 corresponds to that of the air communicating valve 80 of the ink cartridge 100 inserted into the cartridge mounting portion 202. Therefore, the pressing portions 216 are provided above the joints 208. In this exemplary embodiment, four pressing portions 216 are arranged in the width direction of the frame 204. Each of the pressing portions 216 is a cylindrical member that protrudes from the inner rear surface of the frame 204 to the front surface in the horizontal direction. A concave portion 217 having a circular shape is formed at the end of the pressing portion 216. When the ink cartridge 100 is inserted into the cartridge mounting portion 202, the pressing portion 216 is inserted into the opening 177 of the ink cartridge 100, and the concave portion 217 contacts and presses the rod 84 of the air communicating valve 80. When the rod 84 is pressed, the air communicating hole 81 is opened.

As shown in FIGS. 9 and 11, the optical sensors 181 are provided on the inner rear surface of the frame 204. The positions of the optical sensors 181 in the height direction correspond to the detecting windows 140 of the ink cartridges 100 inserted into the cartridge mounting portions 202. Therefore, the optical sensor 181 is disposed above the joint 208 and below the pressing portion 216. In this exemplary embodiment, four optical sensors 181 are provided in the width direction of the frame 204 to correspond to four ink cartridges 100 inserted into the cartridge mounting portion 202. In FIG. 9, the rightmost optical sensor 181 is concealed by the frame 204. The optical sensor 181 outputs a signal for detecting whether the amount of ink in the ink chamber 102 of the ink cartridge 100 is less than a threshold value.

As shown in FIG. 11, the optical sensors 182 are provided on the inner surface of the upper plate of the frame 204. The positions of the optical sensors 182 in the height direction correspond to the detected portions 186 of the ink cartridges 100 inserted into the cartridge mounting portions 202. Therefore, the optical sensor 182 is disposed above the pressing portion 216. In this exemplary embodiment, four optical sensors 182 are provided in the width direction of the frame 204 to correspond to four ink cartridges 100 inserted into the cartridge mounting portion 202. The optical sensor 182 outputs a signal for determining whether the ink cartridge 100 is inserted into the cartridge mounting portion 202. In addition, the optical sensor 182 outputs a signal for determining the kind of ink cartridge 100 inserted into the cartridge mounting portion 202.

The optical sensors 181 and 182 are so-called photo interrupters. When light emitted from the light-emitting element is received by the light-receiving element, the optical sensors output electric signals corresponding to the intensity of the received light. The optical sensors 181 and 182 are connected to a main control unit 250 (see FIG. 12), and the main control unit 250 performs a determining process based on the outputs of the optical sensors 181 and 182.

As shown in FIGS. 9 to 11, lock arms 230 are provided on the upper surface of the frame 204. The lock arm 230 is for locking the ink cartridge 100 inserted into the cartridge mounting portion 202 to be in an inserted state. Four lock arms 230 are arranged in the width direction of the frame 204 to correspond to four ink cartridges 100.

As shown in FIG. 11, the lock arm 230 extends from the front surface of the frame 204 to the inner rear surface thereof and is then bent in a crank shape with respect to the extension direction. A supporting shaft 232 is provided at a middle part of the lock arm 230, in the direction in which the lock arm extends. The supporting shaft 232 has a pin shape protruding from both ends of the lock arm 230 in the width direction. Although not shown in detail in FIG. 11, a pair of bearings capable of supporting the supporting shaft 232 is formed in the vicinity of the upper surface of the frame 204, and the supporting shaft 232 is rotatably supported by the pair of bearings. In this way, the lock arm 230 is supported by the frame 204 so as to be rotatable on the supporting shaft 232.

The lock arm 230 has an operating lever 234 at a first end that is disposed on the front side of the frame 204 and the lock portion 237 at a second end that is disposed on the rear side of the frame 204. The operating lever 234 protrudes from the front surface of the frame 204, and the upper surface of the operating lever 234 is formed in a concave shape corresponding to the finger. The thickness of the lock arm 230 in the width direction, that is, in the horizontal direction that is orthogonal to the insertion direction 30 of the ink cartridge 100 is smaller than that of the ink cartridge 100. Therefore, the lock arm 230 is provided within the width range in which the ink cartridge 100 is accommodated. The lock portion 237 has a circumferential surface with respect to the extension direction at lower side, and the leading end of the lock portion 237 is substantially vertical to the extension direction.

In the lock arm 230, when the operating lever 234 is pushed down, a lower corner 243 of the crank-shaped portion contacts the protruding piece 236 of the frame 204 below the operating lever 234, thereby regulating the rotation of the lock arm 230. An upper edge portion 205 of the front surface of the frame 204 contacts the upper surface of the lock arm 230 and regulates the rotation of the lock arm 230. That is, the rotation of the lock arm 230 is regulated by the upper edge portion 205 and the protruding piece 236 of the frame 204.

A coil spring 219 is provided between the lock arm 230 and the frame 204. A hooking portion 241 is provided on the crank-shaped portion of the lock arm 230 so as to protrude from the upper surface of the lock arm upward in a hook shape. The hooking portion 241 is hooked to one end of the coil spring 219. A hooking portion 239 that is hooked to the other end of the coil spring 239 protrudes from the upper surface of the frame 204 in the horizontal direction. Four hooking portions 239 are formed in the frame 204 to correspond to four lock arms 230. The coil spring 219 is provided between the lock arm 230 and the frame 204 such that both ends thereof are hooked by the hooking portions 239 and 241. The coil spring 219 extends between the lock arm 230 and the frame 204 to generate contractile force. The contractile force of the coil spring 219 causes the lock arm 230 to be rotated in the clockwise direction (in the direction of an arrow 245) of FIG. 11.

When no external force is applied to the operating lever 234, the lock arm 230 is urged by the coil spring 219 in the direction of the arrow 245, and the rotation of the lock arm 230 is regulated by the upper edge portion 205. This posture of the lock arm 230 is referred to as a fourth posture. At the fourth posture, the upper surface of the operating lever 234 is aligned substantially in the horizontal direction, and the lock portion 237 protrudes from the inner surface of the frame 204 downward. At the fourth posture, the lock portion 237 contacts the ink cartridge 100 inserted into the cartridge mounting portion 202. Specifically, at the fourth posture, the lock portion 237 is engaged with the stopper 125 of the ink cartridge 100, and regulates the movement of the ink cartridge 100 inserted into the cartridge mounting portion 202 in the removal direction 29. When the operating lever 234 is pressed down against the contractile force of the coil spring 219, the lock arm 230 is rotated in a direction opposite to the arrow 245, and the lock portion 237 is retracted into the frame 204 (see FIG. 13) This posture of the lock arm 230 is referred to as a third posture. At the third posture, the lock portion 237 does not contact the ink cartridge 100 inserted into the cartridge mounting portion 202.

[Main Control Unit 250]

Next, the schematic configuration of the main control unit 250 of the multi-function machine 10 will be described. The main control unit 250 controls the overall operation of the multi-function machine 10. As shown in FIG. 12, the main control unit 250 is configured by a microprocessor including a central processing unit (CPU) 251, a read only memory (ROM) 252, a random access memory (RAM) 253, an electrically erasable and programmable read only memory (EEPROM) 254, and an application specific integrated circuit (ASIC) 255. In the main control unit 250, the components are connected to each other by a bus 257 so as to be communicable with each other.

The ROM 252 stores a program for allowing the CPU 251 to control various operations of the multi-function machine 10 or a program for allowing the liquid crystal display 27 to display error information, status information, or information for prompting the user to replace the ink cartridge 100. The RAM 253 is used as a storage area or a work area that temporarily stores various data used when the CPU 251 executes the programs. The EEPROM 254 stores setup information and flags that are maintained even when power is turned off.

The ASIC 255 is connected to, for example, a head control circuit 260 or a driving circuit 263 that drives a driving device 264, such as a sheet feed device or a transport device, of the multi-function machine 10, which is an example of an ink consuming apparatus. The head control circuit 260 controls the driving of a recording head 261 based on signals (control signals and image signals) input from the ASIC 255. In this way, the recording head 261 can selectively discharge color inks from the nozzles at a specific timing. In addition, the driving circuit 263 operates the sheet feed device or the transport device at a specific timing.

The liquid crystal display 27 is connected to the main control unit 250. Information stored in the RAM 253 or the EEPROM 254, or information obtained by the operation of the CPU 251 is output to the liquid crystal display 27 through the bus 257. In this way, various information items are displayed on the liquid crystal display 27.

Four optical sensors 181 are connected to the main control unit 250. Each of the optical sensors 181 outputs a signal (hereinafter, referred to as a sensor signal) corresponding to the brightness of light (the amount of light) received by the light-receiving element. Specifically, each of the optical sensors 181 outputs an analog electric signal (a voltage signal or a current signal) corresponding to the brightness of light that is emitted from the light-emitting element of the optical sensor 181 and then received by the light-receiving element. The output sensor signal is input to the main control unit 250. When the electric level (a voltage value or a current value) of the sensor signal is higher than a threshold value, the main control unit 250 determines that the received sensor signal is a high-level signal. When the electric level is lower than the threshold value, the main control unit 250 determines that the received sensor signal is a low-level signal. In this exemplary embodiment, when light traveling through the optical path of the optical sensor 181 is shielded, the sensor signal is determined as a low-level signal. On the other hand, when no light is shielded, the sensor signal is determined as a high-level signal.

When the sensor signal output from each of the optical sensors 181 is at a low level, the main control unit 250 determines that the amount of ink remaining in the ink cartridge 100 corresponding to the optical sensor 181 is more than a threshold value. When the sensor signal output from each of the optical sensors 181 is at a high level, the main control unit 250 determines that the amount of ink remaining in the ink cartridge 100 corresponding to the optical sensor 181 is less than the threshold value, and counts the amount of ink discharged from the nozzles of the recording head 261 from the ink cartridge 100, thereby monitoring a variation in the remaining amount of ink. If the remaining amount of ink is less than a lower limit, the CPU 251 controls the display 27 to display information indicating that the ink cartridge 100 needs to be replaced.

The optical sensor 182 is connected to the main control unit 250. The optical sensor 182 has the same configuration as the optical sensor 181, and outputs a sensor signal corresponding to the brightness of light (the amount of light) received by the light-receiving element.

[Insertion of Ink Cartridge 100]

Next, the insertion of the ink cartridge 100 into the cartridge mounting portion 202 will be described. As shown in FIG. 11, when the ink cartridge 100 is not inserted into the cartridge mounting portion 202 and no external force is applied to the operating lever 234 of the lock arm 230, the lock arm 230 is maintained at the fourth posture by the contractile force of the coil spring 219. At the fourth posture, the upper surface of the operating lever 234 is aligned in the horizontal direction, and the lock portion 237 protrudes from the inner surface of the frame 204 downward. When the ink cartridge 100 is inserted into the cartridge mounting portion 202, the lock portion 237 contacts the ink cartridge 100. Before the ink cartridge 100 is inserted, the slider 41 is disposed at the first position by the urging force of the coil springs 48 and 49.

When the ink cartridge 100 is inserted, as shown in FIG. 13, the ink cartridge 100 is inserted into the cartridge mounting portion 202 through the opening 207 of the frame 204. The insertion direction 30 of the ink cartridge 100 is the horizontal direction. The lower surface of the ink cartridge 100 is fitted into the guide groove 206 formed in the frame 204. When the ink cartridge 100 is pressed into the cartridge mounting portion 202, the ink cartridge 100 is guided in a straight line to the cartridge mounting portion 202 in the depth direction by the guide groove 206. With the lower surface of the ink cartridge 100 being supported by the guide groove 206, the axis 151 (the flow direction of ink) of the ink supply port 91 of the ink supply valve 90 is the horizontal direction, and is aligned with the insertion direction 30 of the ink cartridge 100. A straight line 152 indicating the inclination of the lower surface 103 of the ink chamber 102 in a longitudinal sectional view is aligned in the horizontal direction. In addition, the axis 153 of the ink needle 209 of the joint 208 is substantially aligned with the axis 151. Herein this posture of the ink cartridge 100 is referred to as a first posture.

On the upper surface 36 of the ink cartridge 100, the lock portion 237 of the lock arm 230 contacts the guide surface 162 of the slider 41. Before the contact, a portion of the upper wall 163 of the slider 41 other than the guide surface 162 or the opening of the sliding groove 171 also contacts the lock portion 237. However, since the lower surface of the lock portion 237 has a circumferential surface with respect to the extension direction, the lock portion 237 is smoothly guided to the guide surface 162 by the circumferential surface. In this way, the lock arm 230 is rotated to the third posture (arrow 246) against the contractile force of the coil spring 219. When the lock arm 230 is rotated, the operating lever 234 is moved down on the front side of the cartridge mounting portion 202, and the upper surface of the operating lever 234 is inclined downward with respect to the horizontal plane. Therefore, it is possible to easily confirm the displacement of the operating lever 234 from the front side of the cartridge mounting portion 202. The user views the inclined operating lever 234 to recognize that the ink cartridge 100 is being inserted into the cartridge mounting portion 202.

When the ink cartridge 100 is further pressed into the cartridge mounting portion 202 in the depth direction, the detected portion 185 of the slider 41 enters the optical path of the optical sensor 181. Then, the detected portion 186 enters the optical path of the optical sensor 182. In this case, the main control unit 250 determines the kind of ink cartridge 100 based on signals output from the optical sensors 181 and 182. Since the determining method is not directly related to the present invention, a detailed description thereof will be omitted.

When the ink cartridge 100 is pressed into the cartridge mounting portion 202 in the depth direction, the pressing portion 216 is inserted into the opening 177 of the slider 41, and the rear wall 161 of the slider 41 contacts the inner rear surface of the cartridge mounting portion 202. In this case, the lock portion 237 slides from the guide surface 162 of the slider 41 to the guide surface 129 of the body cover 42. As described above, the step portion corresponding to the thickness of the upper wall 163 of the slider 41 is formed between the guide surface 129 and the guide surface 162. Even when the lock portion 237 contacts the guide surface 129, the operating lever 234 of the lock arm 230 is maintained with the upper surface thereof inclined downward. The detected portion 185 is out of the optical path of the optical sensor 181, and the cutout 187 enters the optical path. The detected portion 186 is maintained on the optical path of the optical sensor 182.

When the ink cartridge 100 is further pressed into the cartridge mounting portion 202 in the depth direction after the slider 41 contacts the inner rear surface of the cartridge mounting portion 202, the coil springs 48 and 49 compressed. The contractile force of the coil springs 48 and 49 is a pressing force for pressing the ink cartridge 100. The slider 41 contacts the inner rear surface of the cartridge mounting portion 202 and stops at that position. Therefore, the body cover 42 is pressed into the cartridge mounting portion 202 while moving relative to the slider 41. As a result, the slider 41 disposed at the first position slides to the second position.

When the body cover 42 is moved, the cartridge body 40 is also moved, and the rod 84 of the air communicating valve 80 contacts the pressing portion 216 and is pressed against the urging force of the coil spring 86. The contractile force of the coil spring 86 is a pressing force for pressing the ink cartridge 100 into the cartridge mounting portion 202. In this way, the air communicating hole 81 is opened, and the ink chamber 102 is opened to the air. In addition, the cap 95 of the ink supply valve 90 is exposed through the opening 178 of the slider 41 and then engaged with the holding portion 210 of the joint 208, and the ink needle 209 is inserted into the ink supply port 91 against the urging force of the coil spring 96. The contractile force of the coil spring 96 is a pressing force for pressing the ink cartridge 100 into the cartridge mounting portion 202. In this case, since the axis 151 of the ink supply port 91 is aligned with the axis 153 of the ink needle 209, the ink needle 209 is reliably inserted into the ink supply port 91. In this way, the ink supply valve 90 is connected to the joint 208, and ink in the ink chamber 102 flows to the outside through the ink supply port 91 and the ink needle 209. In addition, the detecting window 140 enters the optical path of the optical sensor 181 and the opening 190. In this state, the optical sensor 181 detects the movement of the indicator 72 of the arm 70 through the detecting window 140.

When the cartridge body 40 is moved relative to the body cover 42, the lock portion 237 of the lock arm 230 slides on the guide surface 129 of the body cover 42 and reaches the rib 127 of the cartridge body 40. Then, the lock portion 237 is guided by the upper surface of the rib 127 and goes over the vertical wall 126 to reach the table portion 124. With the movement of the lock portion 237, the lock arm 230 is further rotated to the third posture (arrow 246), and then rotated to return to the fourth posture (arrow 245). In this way, the upper surface of the operating lever 234 becomes horizontal again. When the lock arm 230 is disposed at the fourth posture, the lock portion 237 comes into contact with the table portion 124.

When the slider 41 is disposed at the second position, it is difficult to further press the ink cartridge 100 into the cartridge mounting portion 202 in the depth direction. The user can perceive from the ink cartridge 100 that a resistance to the pressing force is increased and the ink cartridge 100 cannot be moved any more. When the lock arm 230 returns from the third posture to the fourth posture and the upper surface of the operating lever 234 returns from the inclined state to the horizontal state, the user can visually recognize that the ink cartridge 100 is completely inserted.

When the user stops pressing the ink cartridge 100 into the cartridge mounting portion 202, the urging force of the coil springs 48 and 49 makes the slider 41 to return from the second position toward the first position. Since the slider 41 contacts the inner rear surface of the cartridge mounting portion 202, the body cover 42 is moved relative to the slider 41 in the direction (the direction opposite to the insertion direction 30) in which it is removed from the cartridge mounting portion 202. In the air communicating valve 80, the urging force of the coil spring 86 makes the rod 84 to return to the position where it protrudes toward the outside. Similarly, in the ink supply valve 90, the urging force of the coil spring 96 makes the valve body 97 to press the ink needle 209 in the direction in which the ink needle is removed from the ink supply port 91.

The lock portion 237 is engaged with the vertical wall 126 of the stopper 125 against the urging force in the direction in which the ink cartridge 100 is removed from the cartridge mounting portion 202, and the cartridge body 40 is prevented from moving in the removal direction 29. As described above, the tip surface of the lock portion 237 is a substantially vertical plane. Therefore, when the tip surface contacts the vertical wall 126, it is not moved to the upper end of the vertical wall 126. As a result, the insertion of the ink cartridge 100 into the cartridge mounting portion 202 is locked.

The movement of the cartridge body 40 in the removal direction 29 is prevented by the engagement between the lock portion 237 and the stopper 125 on the upper surface 36. However, the coil springs 48 and 49 and the coil springs 86 and 96 substantially uniformly urge the upper and lower parts of the cartridge body 40 in the removal direction 29 on the rear surface 34 of the cartridge body 40. As a result, the cartridge body 40 is rotated about an engaging portion between the lock portion 237 and the stopper 125 such that the lower surface 37 of the cartridge body 40 is moved in the removal direction 29. The rotation of the cartridge body 40 is allowed in a specific range by the backlash between the cartridge mounting portion 202 and the ink cartridge 100.

As described above, when the cartridge body 40 is rotated, the axis 151 of the ink supply port 91 of the ink supply valve 90 is inclined with respect to the horizontal direction so that the downstream side of the ink supply port in the direction in which ink is drained is lower than the upstream side. Herein, this posture of the ink cartridge 100 is referred to as a second posture. When the ink cartridge 100 is displaced, the axis 153 of the ink needle 209 maintained in the horizontal direction intersects the axis 151 of the ink supply port 91, and the ink needle 209 is bent in the ink supply port 91. However, the ink supply valve 90 allows the bending of the ink needle and maintains the liquid-tightness of the ink supply port 91 and allows ink to drain from the ink chamber 102 to the outside through the ink needle 209. When the ink cartridge 100 is disposed at the second posture, the straight line 152 indicating the inclination of the lower surface 103 of the ink chamber 102 is inclined such that the ink supply port 91 is inclined downward, similar to the axis 151. Therefore, ink in the ink chamber 102 leans toward the ink supply port 91 along the lower surface 103. When ink is consumed, the level of ink in the ink chamber 102 is lowered. However, ink remains in a space on the lower surface 103 close to the ink supply port 91 in the vicinity of the lower surface 103. That is, ink remains in a space on the lower surface 103 close to the front surface 35, and the ink supply port 91 is not exposed to the air layer of the ink chamber 102 regardless of the remaining amount of ink.

When ink is supplied from the ink supply device 200 to a recording head of a printer unit 12 and ink in the ink cartridge 100 is consumed, the level of ink in the ink chamber 102 is gradually lowered. If the amount of ink in the ink chamber 102 is equal to less than a threshold value, as described above, the floating portion 73 is moved down, and the arm 70 is also rotated at an angle corresponding to the movement of the floating portion. When the arm 70 is rotated, the indicator 72 is moved up in the detecting window 140. When the indicator 72 is moved out of the optical path of the optical sensor 181, the optical sensor 181 outputs a high-level signal. The main control unit 250 determines whether the remaining amount of ink in the ink chamber 102 is equal to or less than a threshold value based on the output of the optical sensor 181, and counts the amount of ink discharged from the recording head 261. If a threshold amount of ink is consumed thereafter, the main control unit 250 determines that no ink in the ink cartridge 100 remains, and controls the display 27 to display information indicating that the ink cartridge 100 needs to be replaced. The user recognizes from the information displayed on the display 27 that it is necessary to replace the ink cartridge 100.

When the ink cartridge 100 is replaced, the operating lever 234 of the lock arm 230 is pressed down in order to unlock the ink cartridge 100. Then, the lock arm 230 is rotated on the supporting shaft 232 in the direction of the arrow 246, and the lock arm 230 is displaced from the fourth posture to the third posture. When the lock arm 230 is disposed at the third posture, the lock portion 237 is separated from the table portion 124 and then moved to a position above the vertical wall 126.

When the lock portion 237 is moved above the vertical wall 126, the movement of the cartridge body 40 in the removal direction 29 is not regulated. Therefore, the cartridge body 40 is moved in the removal direction 29 by the urging forces of the coil springs 48 and 49 and the coil springs 86 and 96, and the slider 41 relatively slides from the second position to the first position. When the slider 41 is moved, the cartridge body 40 is displaced from the second position to the first position. In addition, in the air communicating valve 80, the rod 84 is moved in the direction in which the rod 84 protrudes toward the outside, and the air communicating hole 81 is closed. In the ink supply valve 90, the ink needle 209 is removed from the ink supply port 91, and the valve body 97 closes up the ink supply port 91. Further, the cap 95 is removed from the holding portion 210 of the joint 208. Even when the slider 41 slides to the first position and the urging forces of the coil springs 48 and 49 and the coil springs 86 and 96 are applied to the cartridge body 40, a portion of the ink cartridge 100 is sprung out from the cartridge mounting portion 202 in the removal direction 29 by inertia force caused by the movement of the cartridge body 40. Then, the user holds both sides of the ink cartridge 100 sprung out from the cartridge mounting portion 202 and takes out it from the cartridge mounting portion 202. In this way, the ink cartridge 100 is removed from the cartridge mounting portion 202.

OPERATIONS AND EFFECTS OF THIS EXEMPLARY EMBODIMENT

As described above, according to the ink supply device 200, the ink cartridge 100 that is inserted into the cartridge mounting portion 202 and is disposed at the first posture where the ink needle 209 is inserted into the ink supply port 91 is moved such that the lock portion 237 is engaged with the stopper 125 and the cartridge body 40 is rotated about the engaging portion between the lock portion 237 and the stopper 125 by the urging forces of the coil springs 48 and 49 and the coil springs 86 and 96, thereby being displaced to the second posture. In this way, the ink cartridge 100 is inclined such that the ink supply port 91 is tilted downward, and ink in the ink chamber 102 leans toward the ink supply port 91 along the lower surface 103. Therefore, it becomes easy to use up ink.

Further, since the insertion direction 30 of the ink cartridge 100 into the cartridge mounting portion 202 is the horizontal direction, the axis 151 of the ink supply port 91 is aligned with the axis 153 of the ink needle 209 in the horizontal direction. Therefore, when the ink needle 209 is inserted into the ink supply port 91, ink leakage is hard to occur. When the ink cartridge 100 is disposed at the second posture, the cartridge body 40 is inclined such that the ink supply port 91 is disposed at the lowest position with respect to the lower surface 103 of the ink chamber 102 in the gravity direction. Therefore, it is possible to reduce the amount of ink remaining in the ink chamber 102.

The ink cartridge 100 includes the floating portion 73 that is displaced according to the amount of ink in the ink chamber 102. The optical sensor 181 detects the position of the floating portion 73, and the main control unit determines the amount of ink remaining in the ink chamber 102 based on signals output from the optical sensor 181. As described above, when the ink cartridge 100 inserted into the cartridge mounting portion 202 is disposed at the second position where a backlash is formed between the ink cartridge 100 and the cartridge mounting portion 202, the position of the ink cartridge 100 is stabilized. In this way, it is not necessary to make an extra amount of ink remain in the ink chamber 102 in consideration of the backlash. As a result, it is possible to reduce the amount of ink remaining in the ink chamber 102.

When the ink cartridge 100 is inserted into the cartridge mounting portion 202, the lock arm 230 is rotated from the fourth posture to the third posture, and the upper surface of the operating lever 234 is inclined. When the ink cartridge 100 is completely inserted into the cartridge mounting portion 202, the lock arm 230 is rotated from the third posture to the fourth posture, and the upper surface of the operating lever 234 becomes horizontal. Therefore, the user views the movement of the operating lever 234 from the front side of the cartridge mounting portion 202, and can check whether the ink cartridge 100 is completely inserted into the cartridge mounting portion 202.

Since the thickness of the lock arm 230 is smaller than that of the ink cartridge 100, it is possible to reduce the size of the ink supply device 200. In particular, as in this exemplary embodiment, when a plurality of cartridge mounting portions 202 are provided in parallel to each other, the effect of reducing the size of an ink supply device becomes more remarkable.

In this exemplary embodiment, the ink cartridge 100 includes the cartridge body 40 and the slider 41, and the coil springs 48 and 49 interposed therebetween urges the ink cartridge 100 inserted into the cartridge mounting portion to the removal direction. However, the present invention is not limited thereto. An elastic member which urges the ink cartridge 100 may be provided in the cartridge mounting portion 202. For example, the ink cartridge 100 may not include the slider 41, and an elastic member, such as a spring that urges the ink cartridge 100 in the removal direction 29, may be provided in the cartridge mounting portion 202. Alternatively, no elastic member may be provided in the cartridge mounting portion 202, and the coil spring 86 of the air communicating valve 80 or the coil spring 96 of the ink supply valve 90 may urge the ink cartridge 100 to the removal direction.

What is claimed is:

1. An ink supply device comprising:

an ink cartridge including:

an ink chamber for storing ink;

a port which is provided in a rear surface thereof at a lower portion of the ink chamber in a gravity direction and which allows ink to flow from the ink chamber to outside in an ink flow direction; and an engaged portion which is provided on an upper surface thereof;

a cartridge mounting portion into which the ink cartridge is insertable in an insertion direction from the rear surface of the ink cartridge, wherein the cartridge mounting portion is configured to accommodate the ink cartridge movably between a first posture in which the ink flow direction of the port is aligned with the insertion direction and a second posture in which the ink cartridge is inclined so that a downstream of the port in the ink flow direction is lower than an upstream of the port;

a joint which is provided in the cartridge mounting portion and is connected to the port of the ink cartridge inserted into the cartridge mounting portion;

a first elastic member which urges the ink cartridge inserted into the cartridge mounting portion to a removal direction opposite to the insertion direction; and a lock member which is engaged with the engaged portion of the ink cartridge inserted into the cartridge mounting portion to prevent the ink cartridge from being moved in the removal direction by the urging force of the first elastic member.

2. The ink supply device according to claim 1, wherein the insertion direction of the ink cartridge is a horizontal direction orthogonal to the gravity direction.

3. The ink supply device according to claim 1, wherein the ink cartridge includes a floating portion which is movable according to an amount of the ink in the ink chamber, and wherein the cartridge mounting portion includes:

a sensor which detects a position of the floating portion; and a determining unit which determines the amount of ink remaining in the ink chamber based on a signal output from the sensor.

4. The ink supply device according to claim 1, wherein the lock member includes:

a lock arm including:

a lock portion which is provided at a first end thereof and is engaged with the engaged portion; and an operating lever provided at a second end thereof opposite to the first end;

a support mechanism which supports the lock arm to be rotatable between a third posture in which the lock portion is disengaged from the engaged portion and a fourth posture in which the lock portion is engaged with the engaged portion; and a second elastic member which urges the lock arm to the fourth posture.

5. The ink supply device according to claim 4, wherein the ink cartridge includes a guide which is provided on the upper surface thereof and extends from the engaged portion to the rear surface, the guide being configured to contact the lock portion to displace the lock arm to the third posture.

6. The ink supply device according to claim 4, wherein a thickness of the lock arm in a direction aligned with a horizontal direction and orthogonal to the insertion direction is smaller than that of the ink cartridge.

7. The ink supply device according to claim 4, wherein a plurality of cartridge mounting portions are arranged in parallel to each other in a direction aligned with a horizontal direction and orthogonal to the insertion direction, and each of the cartridge mounting portions includes the joint, the first elastic member, and the lock member.

8. The ink supply device according to claim 1, wherein the first elastic member is provided in the ink cartridge.

9. The ink supply device according to claim 1, wherein the first elastic member is provided in the cartridge mounting portion.

10. The ink supply device according to claim 1, wherein when the lock member is engaged with the engaged portion of the ink cartridge after the ink cartridge is inserted into the cartridge mounting portion, the ink cartridge is rotated to the second posture about an engagement point between the lock member and the engaged portion.

11. An ink cartridge accommodating device for accommodating an ink cartridge including a first part, a second part movable relative to the first part in a movement direction, and a spring which is provided between the first part and the second part and urges to be separated in the movement direction, wherein the first part includes a port which extends in a first extending direction and allows an ink therein to flow outside, the ink cartridge accommodating device comprising:

a cartridge accommodating portion into which the ink cartridge is insertable from the second part in an insertion direction aligned with the first extending direction, the cartridge accommodating portion including a joint extending in a second extending direction to which the port of the ink cartridge is connected, the cartridge accommodating portion configured to accommodate the ink cartridge movably between a first posture in which the first extending direction of the port is aligned with the second extending direction of the joint and a second posture in which the first extending direction of the port is inclined from the second extending direction of the joint; and a lock member which is provided at an upper portion of the cartridge accommodating portion and is configured to contact a portion of the first part of the ink cartridge inserted in the cartridge accommodating portion.

12. The ink cartridge accommodating device according to claim 11, wherein when the ink cartridge is inserted into the cartridge accommodating portion, the first part is urged to a removal direction opposite to the insertion direction by the spring, and wherein the lock member is configured to regulate the first part to move to the removal direction.

* * * * *